US005146991A

United States Patent [19]

Rogers, Jr.

[11] Patent Number: 5,146,991

[45] Date of Patent: Sep. 15, 1992

[54] METHOD FOR WELL PRODUCTION

[75] Inventor: Jack R. Rogers, Jr., Tyler, Tex.

[73] Assignee: Delaware Capital Formation, Inc., Wilmington, Del.

[21] Appl. No.: 684,162

[22] Filed: Apr. 11, 1991

[51] Int. Cl.[5] ..... E21B 34/16; E21B 43/12

[52] U.S. Cl. ..... 166/369; 166/53; 137/624.15; 137/552.7; 137/624.2

[58] Field of Search ..... 166/53, 64, 66, 369, 166/370, 372; 137/624.2, 624.15, 552.7

[56] References Cited

U.S. PATENT DOCUMENTS

| | | | |
|---|---|---|---|
| 3,219,107 | 11/1965 | Brown, Jr. et al. | 166/53 X |
| 4,304,989 | 12/1981 | Vos et al. | 137/624.2 X |
| 4,352,376 | 10/1982 | Norwood | 137/552.7 X |
| 4,526,228 | 7/1985 | Wynn | 166/53 |
| 4,664,602 | 5/1987 | Gordon | 166/53 X |
| 4,685,522 | 8/1987 | Dixon et al. | 137/624.2 X |
| 4,854,164 | 8/1989 | Rhoads | 166/53 X |
| 4,921,048 | 5/1990 | Crow et al. | 137/624.2 X |
| 4,989,671 | 2/1991 | Lamp | 137/624.2 X |

*Primary Examiner*—William P. Neuder
*Attorney, Agent, or Firm*—Mueller and Smith

[57] ABSTRACT

A method for producing a plunger lift well which optimizes production through the evaluation of the speed at which a plunger arrives at the wellhead within a fixed on-cycle interval. Time interval windows representing fast, good, and slow plunger performance are established and, based upon plunger performance with respect to these windows, afterflow time and off-cycle intervals are varied toward an achievement of plunger arrivals within the good window. A minimum off-time is established as a limit. The method may be employed with two motor valves, one performing in conjunction with a sales and the other to low pressure such as the atmospheric pressure of a tank or a low pressure sales line. In the event of failure of the plunger to arrive within the on-cycle interval, resort is made to the tank cycle. Additionally, an afterlow delay cycle is provided as well as a delay cycle intended for response to high sales line pressure conditions.

22 Claims, 12 Drawing Sheets 10
34
36
32
74
72
70
77
78
76
14
86
50
30
88
38
40
52
48
80
28
42
26
84
24
64
66
62
60
22
44
58
12
46
16
56
V
82
20
18

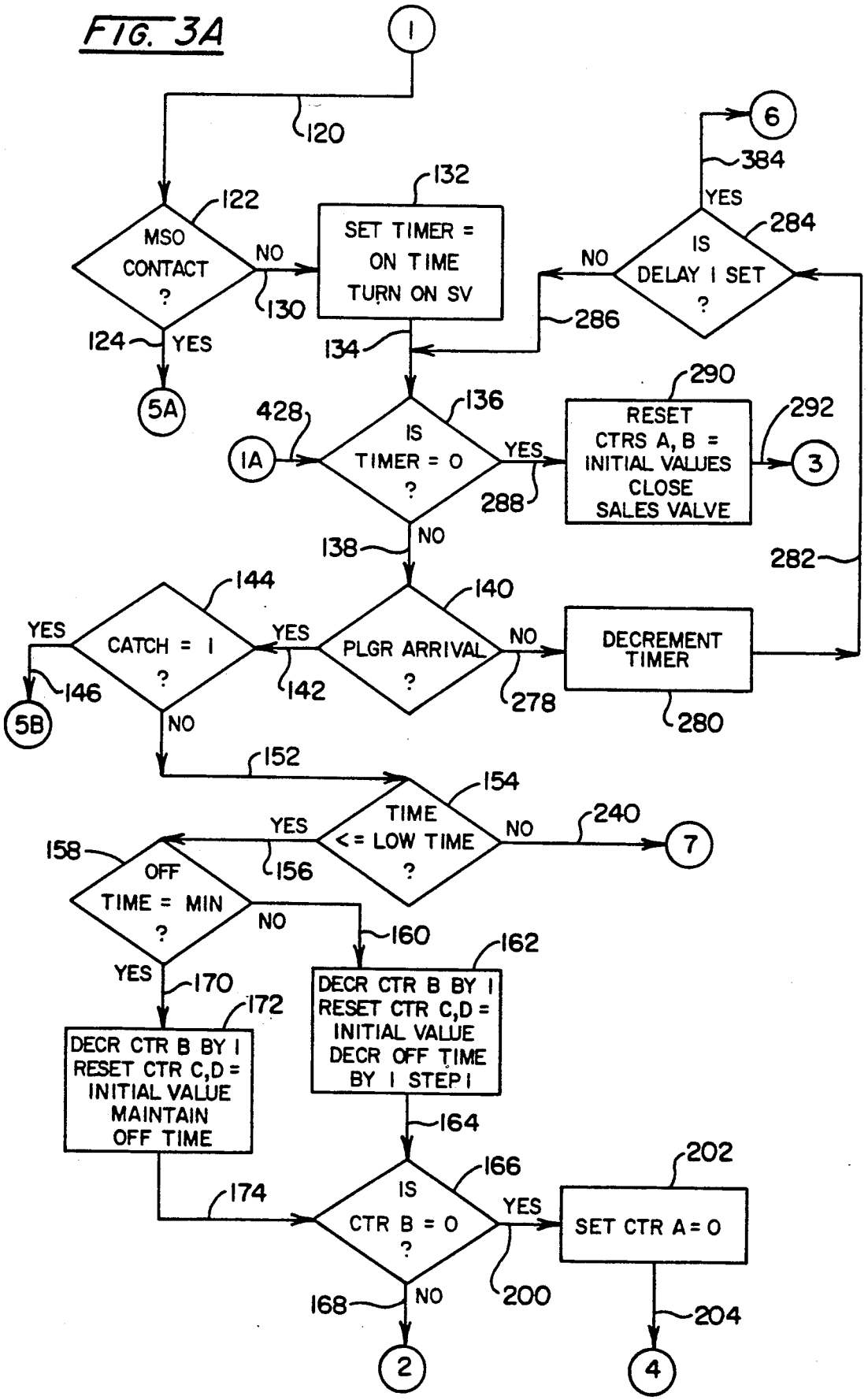
FIG. 3A
1
120
122
MSO CONTACT ?
NO
130
124
YES
5A
132
SET TIMER = ON TIME TURN ON SV
134
6
384
YES
284
IS DELAY 1 SET ?
NO
286
428
1A
136
IS TIMER = 0 ?
YES
288
290
RESET CTRS A, B = INITIAL VALUES CLOSE SALES VALVE
292
3
138
NO
282
144
CATCH = 1 ?
YES
146
5B
NO
142
140
PLGR ARRIVAL ?
YES
NO
278
DECREMENT TIMER
280
152
154
TIME <= LOW TIME ?
YES
156
NO
240
7
158
OFF TIME = MIN ?
NO
160
YES
170
172
DECR CTR B BY 1 RESET CTR C,D = INITIAL VALUE MAINTAIN OFF TIME
162
DECR CTR B BY 1 RESET CTR C,D = INITIAL VALUE DECR OFF TIME BY 1 STEP 1
164
174
166
IS CTR B = 0 ?
YES
200
202
SET CTR A = 0
204
168
NO
2
4

2
176
178
C = 0
D = 0
?
YES
314
5
NO
180
182
SET TIMER
= OFF TIME
CLOSE VALVE
START OFF TIME
6
382
YES
196
184
IS
DELAY 1 SET
?
2A
436
NO
194
186
IS
TIMER = 0
?
YES
192
198
190
1
NO
188
DECREMENT
OFF CTR
EACH MINUTE
4
210
212
ADD 1 STEP2
TO DELAY2
4A
262
214
216
SET TIMER =
DELAY2
START DELAY2
218
230
220
DECREMENT
TIMER

NO
228
222
IS
DELAY 1 SET
?
YES
6
452
224
4B
TIMER = 0
?
NO
226
232
YES
2

METHOD FOR WELL PRODUCTION

BACKGROUND OF THE INVENTION

The production of fluid hydrocarbons from wells involves a technology based on a long history of experience. While wells within some geographic regions are capable of producing under naturally induced reservoir pressures, more commonly encountered are well facilities which employ some form of an artificial lift production procedure. Among those latter lifting techniques are a non-pumping, gas lifting variety where, in general, a cycled opening and closing of the well is carried out. Under this approach, natural gas pressures, whether artificially or naturally induced, are permitted to build at a closed well in conjunction with an inflow of liquids, usually present as some combination of oil and saltwater. As a proper combination of pressure and liquid in flow quantity develops, the well is opened to a gathering system or receiving facility. Such gathering systems will vary, but conventionally include a gas/liquid separator, one or more sales lines, and a tank or reservoir for collecting liquids issuing from the well during its open interval.

The terminology associated with well production, in many instances representing somewhat colorful argots, has varied somewhat in meaning as technology has progressed over the years. All cyclical production now is generally referred to as "intermitting", and the intermitting process provides for the provision of alternating on-cycles or states and off-cycles or states. Where a well is closed as a consequence of the termination of cyclical control, it is said to be "shut-in". Conventionally, the cyclical opening and closing procedure is carried out with a gas driven motor valve which when utilized in conjunction with opening conduits to a gas sales line is referred to as a "sales valve".

The timing involved in intermitting a well has long been considered critical. Production of the well occurs only during an on-cycle which will remain for a relatively short interval following which the off-cycle is carried out. The deriving of the timing of these cycles has always been a taxing endeavor to well technicians. Many production parameters are considered for this task no two wells exhibiting the same performance signature and, importantly, the performance signature of any given well changing with time. This in the past has called for the presence of the well technician at the well location on a quite frequent basis to observe the many well parameters involved including tubing pressure, casing pressure, sales line pressure, and many other heuristic details. A failure of the intermitting process results in an excessive quantity of liquids within the tubing string referred to generally as a "loading up" of the well. This condition represents a failure which may be quite expensive to correct.

Many well installations employ a plunger method of artificial lift wherein a piston which is referred to as a "plunger" is slideably installed within the tubing string of the well and is permitted to travel the entire length of that tubing string in conjunction with the on-cycle and off-cycle of the well. The most important requirement for plunger lift practice is that the plunger itself arrive at the well head in the course of each on cycle. Generally, plunger lift is classified as a separate and distinct method of artificial lift, although in some instances, it serves as only a temporary means of keeping a well commercially feasible prior to the installation of another method of artificial lift. Some of the more common applications of plunger lift are as follows:

(1) utilization in a high gas-liquid ratio well to maintain production by cyclical operation;
(2) utilization in a gas well to unload accumulated liquids;
(3) utilization in an oil or gas well to keep the tubing string clean of paraffin, scale, and the like; and
(4) utilization in conjunction with intermittent gas lift to reduce liquid fall-back.

The introduction of a plunger to a lift cycle provides a solid and sealing interface between the lifting gas and the produced liquid slug. This interface so provided by the plunger changes the flow pattern of the gas during a lifting cycle from the familiar ballistic shape of gas penetration of the liquid slug to a pattern wherein gas flow is possible only in the annular space between the tubing walls and the outside surface of the plunger.

Since the lift gas pressure under the plunger must be greater than the pressure created by the gas column pressure plus the liquid load above the plunger, the small quantity of gas that by-passes the plunger flows upwardly through the annular space and acts as a sweep, thus minimizing any tendency for liquid fall-back. The elimination of possible gas penetration through the center of the liquid slug and the minimization of any liquid fall-back makes the plunger application a most efficient form of intermittent production.

For a substantial period of time, control over the cyclical production of wells has been based simply upon a crude, clock-operated device. This device required hand winding and thus well location visitation by technicians on a quite frequent basis. Inasmuch as those locations are, for the most part, difficult to access areas, the earlier spring-wound controllers were the source of much frustration to the industry. That frustration commenced to end with the introduction to the industry of a long life battery operated controller by W. L. Norwood in about 1978. Described in U.S. Pat. No. 4,150,721, this seminal electronic controller provided for long term, battery operated control over wells and served to simplify the control adjustment procedure required of well technicians. Of particular importance, the controller is designed to respond to system parameters to override the cycle timing to accommodate conditions where such timing should be overridden and subsequently re-initiated on an automatic basis. Sold under the trademark "Digitrol", the controller has been seen to have had a profound impact upon well production.

In 1980, W. L. Norwood and Logic Controls Corporation introduced the microprocessor driven controller to the industry. This instrument, marketed under the trademark "Liquilift", gave the well technician a substantially expanded capability and flexibility for well control, providing for response to a substantial number of well parameters, as well as for the development of delay techniques to accommodate for temporary system excursions and the like. The initial version of the Liquilift device is described in U.S. Pat. No. 4,352,376, by Norwood, entitled "Controller for Well Installations", issued Oct. 5, 1982. Subsequently, still further upgraded versions of the initial microprocessor driven controller had been introduced to the industry and are marketed as "Liquilift II" and for dual motor valve operation, the "Liquilift II+2" and "Liquilift II+2T".

Given the substantially improved flexibility of these latter, computer driven instruments, the industry now seeks techniques for their use wherein the controller, in effect, represents the presence of a well technician at a well location on a continuous basis. With such continuous fine tuning of a well, industry anticipates a production technique which can be maximized without resort to driving the well to incipient failure.

SUMMARY

The present invention is addressed to a method for operating a well installation employing plunger lift procedures. Utilizing the operational flexibility of the microprocessor based controller, a continuous monitoring and adjustment of well performance is carried out through an evaluation of plunger speed. The speed at which the plunger travels from the bottom of the tubing string of the well to the wellhead is evaluated by each cycle. Based upon that evaluation, changes may be made to the off-cycle time and afterflow cycle time to tune the well toward a performance which is optimized at a consistent plunger speed considered to achieve maximized production.

To achieve plunger speed-based control, the well technician, relying on experience and judgement, selects a consistent on-cycle interval and, within that interval, windows are then set to reflect fast, good, and slow speeds for the plunger to arrive at the wellhead. These windows are developed by electing low-time and high-time settings and loading them into the controller. Instead of the technician forcing the well to perform to pre-conceived operating times and pressures, the technician only is required to change the operating windows to be more or less aggressive. The production method will make no change to operating times if the plunger continues to surface at a good plunger speed as evidenced by arriving within a good window. However, the production technique will decrease the off-cycle time and increase the afterflow time should the plunger surface within a fast window. Conversely, the approach will increase the off-time interval and decrease the afterflow time should the plunger surface within a slow window. The technique seeks to avoid failure of the plunger to surface during an on-time. However, should such a failure occur, additional off-time is added to allow for pressure build-up.

The production technique further is capable of performing in conjunction with two motor valves, one operating as a sales valve and the other as a tank valve or valve to a lower pressure sales line. The latter motor valve can be operated to allow for emergency venting should abnormal operating conditions exist. Override capability is made possible where sales line pressures may exceed normal operating conditions and a shut-in capability is programmable where consecutive failures of plunger arrival or slow plunger runs are encountered. Complete program control of time adjustments and others can be altered or manipulated in the field by the well operator both to maximize well production through consistent plunger speed performance, and for the purpose of maintenance convenience, for example, providing cycle termination but control parameter maintenance where the plunger is to be recovered for maintenance or the like.

Another feature of the invention provides a method for operating a well installation having a control valve regulating the flow of fluid hydrocarbon from a well tubing string to a sales line is selectively actuated between an on-state and an off-state, and wherein a plunger is located within the tubing string of the well for movement between a lower region and a wellhead sensing position which comprises the steps of:

assigning first values corresponding with the rate of movement of the plunger from the lower region to the wellhead which represents normal plunger performance;

assigning second values less than the first values corresponding with the rate of movement of the plunger from the lower region to the wellhead which represent slow plunger performance;

assigning a predetermined value for the time interval of the on-state;

assigning a predetermined value for the time interval of the off-state;

actuating the control valve to transition from an off-state to an on-state;

then detecting the arrival of the plunger at the wellhead prior to expiration of the time interval of the on-state, and determining the time elapsed from that actuation;

determining the presence of any coincidence with the assigned second values of plunger rate of movement corresponding with the time elapsed;

then increasing the predetermined value for the time interval of the off-state by a predetermined first time increment when a coincidence with the assigned second value is present; and terminating the on-state in response to plunger detection, and actuating the control valve to transition from the on-state to the next off-state in response to the on-state termination.

Another feature of the invention provides a method for operating a well installation having a sales control valve regulating the flow of fluid hydrocarbon from a well tubing string to a sales line is selectively actuated to establish an on-state and an off-state, wherein a tank is provided for receiving fluid, and wherein a plunger is located within the tubing string for movement between a lower region and a wellhead sensing position, comprising the steps of:

providing a tank control valve coupled for regulating the flow of fluid hydrocarbon from the well tubing string to the tank, the tank control valve being actuable to establish a tank on-state and further actuable to close fluid flow communication between the tubing string and the tank;

assigning select values corresponding to the rate of movement of the plunger from the lower region to the wellhead which represent predetermined plunger performance;

assigning a value for a tank-on-time interval;

assigning a predetermined value for the time interval of the on-state;

assigning a predetermined value for the time interval of the off-state;

actuating the sales control valve to transition from an off-state to an on-state and commencing the timing of the on-state;

providing an arrival signal when the plunger arrives at the wellhead subsequent to the actuation of the sales control valve in transition to the on-state;

actuating the sales control valve to the off-state when the time interval of the on-state is concluded in the absence of the arrival signal;

determining the presence of a tank cycle condition when the time interval of the on-state is concluded in the absence of the arrival signal;

actuating the tank control valve in response to the tank cycle condition to establish the tank on-state and commencing the timing of the tank on-time interval; and actuating the tank control valve to close and terminate the fluid flow communication in response to the arrival signal and commencing the timing of the off-state.

Another feature of the invention provides a method for operating a well installation having a control valve regulating the flow of hydrocarbon from a well tubing string to a sales line is selectively actuated between an on-cycle and an off-cycle, and wherein a plunger is located within the tubing string of the well for movement between a lower region and a wellhead sensing position, comprising the steps of:

assigning a predetermined fixed value for the time interval of an on-cycle;

assigning first values corresponding with the rate of movement of the plunger from the lower region to the wellhead which represent normal plunger performance;

assigning second values corresponding with the rate of movement of the plunger from the lower region to the wellhead which represent fast plunger performance;

assigning a predetermined initial value for the time interval of the off-cycle;

assigning a predetermined minimum value for the time interval of the off-cycle;

actuating the control valve to transition from the off-cycle to the on-cycle;

providing an arrival signal when the plunger arrives at the wellhead subsequent to the actuation of the control valve to transition to the on-cycle;

determining the presence of a fast plunger rate when the arrival signal occurs within a time interval from the on-cycle control valve actuation corresponding with the second values;

decreasing the initial value for a time interval of the off-cycle by a predetermined increment of time in response to the determination of a fast plunger rate to derive an adjusted value for the time interval of off-cycle; and maintaining the predetermined minimum value for the time interval of the off-cycle when the adjusted value is equal thereto.

Another feature of the invention provides a method for operating a well installation having a sales control valve regulating the flow of hydrocarbon from a well tubing string to a sales line is selectively actuated between open and closed orientations for respectively deriving an on-cycle and an off-cycle, wherein a plunger is located within the tubing string for movement between a lower region and a wellhead sensing position, and wherein a switching gauge is operatively associated with the sales line to derive a high line signal when pressure within the sales line reaches a predetermined threshold level, comprising the steps of:

actuating the sales control valve from the closed orientation to the open orientation to commence an on-cycle;

timing the on-cycle for an on-cycle control interval;

timing an afterflow extension of the on-cycle for an afterflow delay interval;

actuating the sales control valve from the on-cycle to the off-cycle at the termination of the afterflow delay interval;

timing the off-cycle for an off-cycle control interval;

commencing the timing of an on-cycle high line delay interval in response to the presence of the high line signal during the timing of the on-cycle and suspending the remaining time of the on-cycle;

responding to the removal of the high line signal during the on-cycle high line delay interval by reinstating the on-cycle for the remaining on-cycle time;

actuating the sales control valve to the closed orientation when the on-cycle high line delay interval terminates during the on-cycle control interval and maintaining the closed orientation until the subsequent removal of the high line signal; and actuating the sales control valve to the open orientation to commence an on-cycle in response to the subsequent removal of the high line signal.

The invention, accordingly, comprises the method possessing the steps which are exemplified in the following detailed disclosure.

For a fuller understanding of the nature and objects of the invention, reference should be had to the following detailed description taken in connection with the accompanying drawings.

BRIEF DESCRIPTION OF THE DRAWINGS

FIGS. 3A and 3B combine to form a flow chart describing an on-cycle control method according to the invention;

DETAILED DESCRIPTION OF THE INVENTION

The control technique described herein is one taking advantage of the improved microprocessor driven controller instrument being utilized by the oil industry. It combines that flexibility with plunger lift based production to achieve a maximized well output of saleable hydrocarbons and recognizes that the production signature of any given well facility will vary continuously. However, the technique further is predicated upon an essentially continuous tuning of the well to achieve plunger lifting performance at a consistent velocity or speed throughout well production. Achieving that consistency of speed is developed initially by the oil technician based upon field experience with the well at hand. For the technique to perform, efficient gas pressure and volume must be present to achieve this consistent plunger velocity. Many theories have been developed for determining the most favorable method of operation of plunger lift equipment. Through extensive field experience, operators have identified or localized limitations of such equipment. However, there are certain basic variables that always will affect overall system performance. These variables may be identified as follows:

1.) Plunger seal efficiency, a factor impacting the speed of movement of the plunger.
2) Gas sales line pressure.
3) Gas/liquid ratio (GLR). A certain GLR is necessitated to operate plunger equipment adequately. Operators generally are seeking, for example, 3,500 to 4,000 standard cubic feet per barrel of liquid. However, a determination to employ plunger lift equipment will depend upon the total system that technician is dealing with.
4) Casing and tubing diameters.
5) Operating depth.
6) Wellhead pressure, manifested as tubing pressure and casing pressure.
7) Liquid slug pressure (water/oil ratio).
8) Surface equipment back pressure including such consideration as the presence of chokes, flow line length, compressor operation, elevations, valves and fittings.
9) Well inflow performance relationship (IPR).
10) Tubing quality.

Heretofore, the complexity of achieving and maintaining optimized well performance has been of such a level that the oil and gas industry has accepted substandard operation from plunger-based artificial lift systems. In effect, optimized performance would require a 24 hour a day visitation on the part of the technician at the well site. The present method utilizes the initial experience of the well operator to establish an ideal plunger rate of movement and then continuously controls, based upon variations of plunger speed to maintain that consistency of plunger operation.

Figure 1:
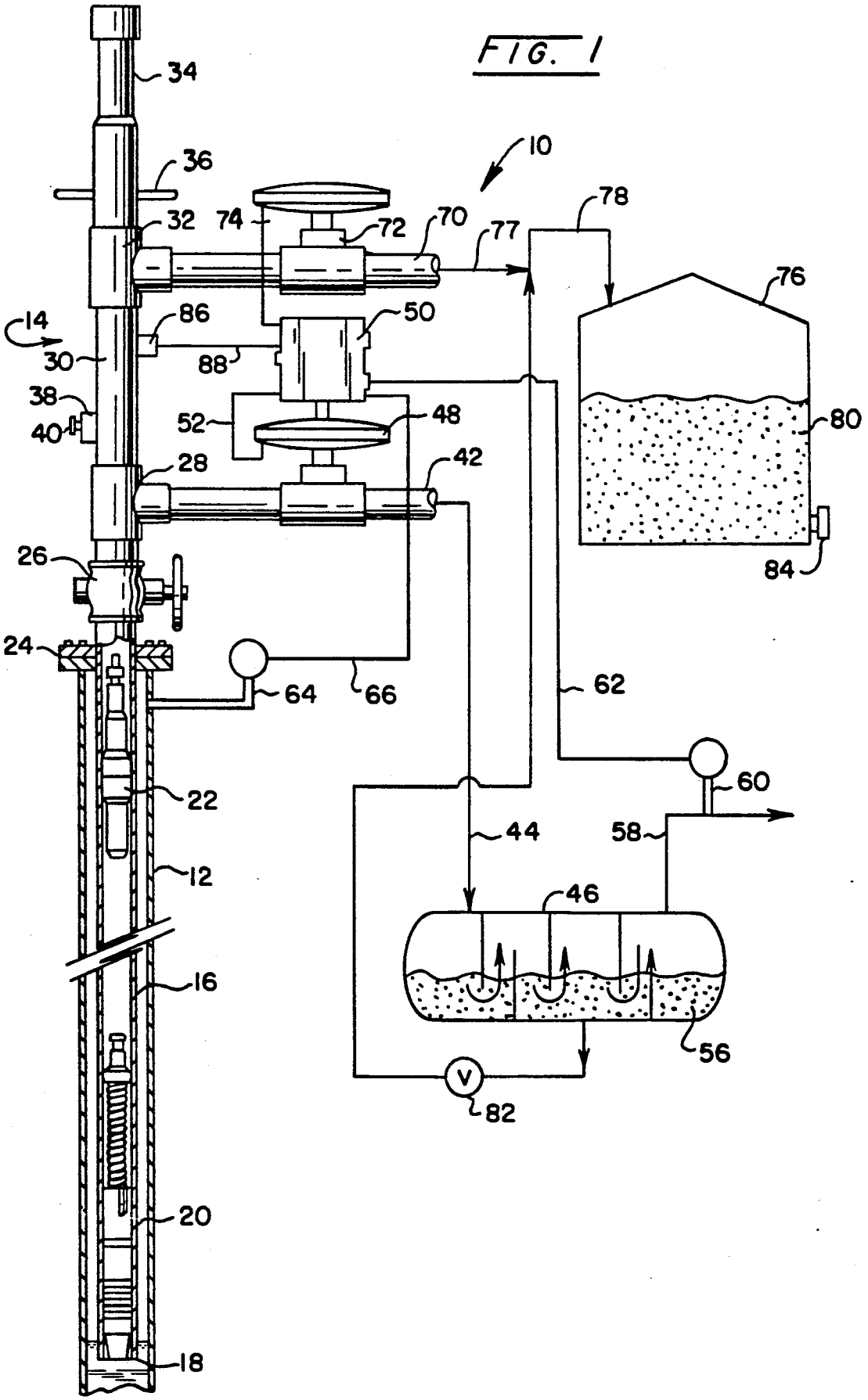
FIG. 1 is a schematic representation of a well installation for plunger lift production according to the method of the invention.

Looking to FIG. 1, a well installation is schematically represented in general at 10. Installation 10 includes an elongate casing 12 which extends through the terrestrial surface into a gas-oil formation which serves as a pressurized reservoir for oil, gas, water and the like. Surface control over the well is maintained by a well head represented generally at 14. Wellhead 14 incorporates apropriate hangers and seals which serve to support a tubing string 16 which extends from the well head 14 to an open lower end 18 situate in the vicinity of the lower level or region of casing 12. Installed above the opening 18 is a bumper structure 20 which functions to stop and limit the travel of a piston-like plunger 22. Plunger 22 is seen adjacent the flange coupling 24 serving to associate the lower well components with wellhead 14. Above flange 24 is a master valve 26 and immediately thereabove a T-connection 28. Wellhead 14 then includes a tube connector portion 30 which extends to another T-connection 32, the top of which is seen to be coupled with a lubricator 34. The lubricator component 34 is threadably engaged with T-connector 32 and is removable by unscrewing it utilizing handles as at 36. Within tube portion 30 there is provided a catcher 38 having a handle 40 which may be manipulated by the well operator to position or arm a plunger dog within the tube portion 30 so as to catch the plunger 22 as it ascends to the lubricator 34. The plunger 22 then can be accessed for maintenance, for example, by removing lubricator 34.

T-connection 28 is seen to provide fluid communication between the tubing string 16 and a conduit represented at piping 42 which extends, in turn, as represented by arrow 44 to a separator represented at 46. Control over the conduit 42 is by a motor valve 48 which, because of its function in the instant system is designated as a "sales valve". The valve 48, in turn, is controlled to open and close conduit 42 by a microprocessor driven controller 50, such control being represented by line 52. The controller 50 may be fashioned similar to that described in Norwood, U.S. Pat. No. 4,352,376, issued Oct. 5, 1982, entitled "Controller for Well Installations", and assigned in common herewith, which is incorporated herein by reference. Preferably, the controller 50 will be provided as a controller marketed under the trademark "Liquilift Autocycle" wellhead controller marketed by Ferguson-Beauregard, Logic Controls, of Tyler, Tex.

Upon the opening of sales valve 48, an initial surge of gas followed by fluid passes through the conduit 42 to the separator 46. Separators as at 46 are provided in a variety of configurations, that illustrated being schematically representative of a single tube horizontal device. The gas and liquid mixture enters separator 46 from conduit 42, whereupon its velocity and directional flow are altered to permit fall-out of heavier liquids to the bottom of the tank as represented at 56. Gas and spray are collected in the upper portions of the separator 46 wherein smaller droplets coalesce to larger ones to join the fluid at 56 and, following final fluid particulate removal, as through mist extractors and the like, gas enters an outlet conduit represented by arrow 58 for entry into a gas sales outlet or sales line. The relatively higher pressure of the sales line as represented at 58 is monitored by a sales line gauge 60. Gauge 60 is of a type having a selectable sales line pressure threshold, the level of which is determined by the operator. Where the pressure in the sales gathering system is too high, and the threshold is reached or exceeded, a "high line contact" is generated as an electrical signal and conveyed as represented by line 62 to the controller 50. Of course, a variety of devices can be employed for this purpose and are intended to be within the meaning of the term.

Returning to the wellhead 14, extending from the T-connection 32 is a conduit 70, upon which is mounted a second motor valve 72 which functions as a tank valve or tank control valve. Tank valve 72 is controlled between on and off states by controller 50 as represented by line 74. This control provides for the opening of tubing string 16 to the low, essentially atmospheric pressure of a tank or reservoir depicted at 76. The flow path for conduit 70 is represented in this regard by arrows 77 and 78. It may be observed that tank 76 retains a collection of liquids 80 which generally will be a combination of salt water and crude petroleum collected, for the most part, from the separator 56 via flow path 78 under the control of a valve as represented at 82. The liquids 80 collected at tank 76 conventionally are removed by tank truck or the like by accessing the material from a lower disposed valve as at 84. Alternately, conduit 70 may be directed to a sales gathering system of low pressure to achieve an equivalent result. The term "tank" or "tank valve" or "tank cycle" as used herein is intended to apply to such other arrangements.

Also coupled to the wellhead 14 at tube connector portion 30 is a plunger detector 86 located above catcher 38. The detector 86 provides a magnetic shut-off on arrival signal (MSO) or plunger arrival signal to the controller 50 as represented by line 88. Additional monitoring devices, for example a tubing pressure gauge casing pressure gauge, and may be provided, however, they are not required for the technique of control at hand. An exemplary casing pressure gauge 64 is shown having an input line 66 directed to controller 50.

Figure 2:
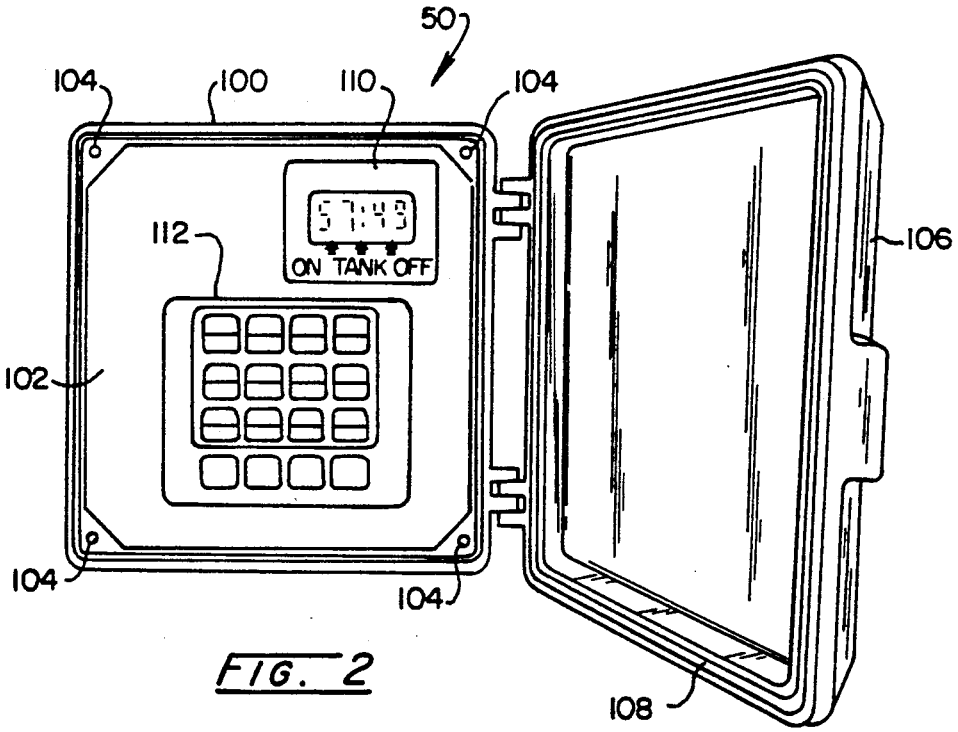
FIG. 2 is a front view of a controller which may be employed with the method of the invention.

Referring to FIG. 2, the containment structure of the controller 50 is revealed and identified generally by the same number. Controller 50 is contained within a highly secure water-tight housing, inasmuch as the environment within which it is called upon to perform often will be quite severe. This housing is, for the most part, configured as described in U.S. Pat. No. 4,532,952 by Norwood, issued Aug. 6, 1985, and assigned in common herewith. The housing is formed having a principal housing component 100, the forward portion of which is seen in FIG. 2 to support a circuit housing or module 102. Module 102 is retained in place, for example, by screws as at 104, located at the corners thereof and, in addition to carrying the circuitry of the controller, also functions to enclose an internal cavity within the principal component 100. A hinged front cover is shown at 106 which hingeably closes over the front or operational surface of the module 102 in water-tight secure fashion against housing component 100. The water-tight integrity of the arrangement is assured through the use of an O-ring seal 108 positioned within a corresponding groove within the inward surface of the front cover 106. Both the housing component 100 and the cover 106 preferably are formed of an impact resistant fiber-reinforced thermosetting resinous material and closure of the cover 106 may be maintained by an over-center latching device (not shown). The face of module 102 is shown to include a liquid crystal display (LCD) 110 which will display a variety of data including on-cycle time, off-cycle time, and various parameters employed with the instant controlling technique. Note that three arrows labeled "on", "tank", and "off" are positioned beneath the display. The software publishes a period above an appropriate one of those arrows to indicate an off-cycle, a tank cycle, or an on-cycle, an off-cycle being represented in the figure. A 16 key keypad is mounted upon module 102 below the readout 110.

In general, the control technique of the invention is one based upon plunger speed and seeks to operate the well such that the plunger performs consistently at an optimum value of speed which initially is determined by the well operator at the time of set-up. As part of this experience based set-up, the operator will select an on-cycle time for the operation of the sales valve 48 and that value is constant, never being decremented or incremented. Then, with the on-time as a base, windows are established representing time element values corresponding with fast plunger rate, a slow plunger rate, and a normal plunger rate. These rates lie within the constant on-time selection of the operator. Instead of the operator forcing the well to perform to preconceived operating times and pressures, a requirement is made only to change the operating windows to be more or less aggressive in producing the well. No change is made to operating times if the plunger continues to surface within what may be deemed a good window. However, the technique will decrease the off-time and increase an afterflow time if the plunger surfaces in a fast window. The system will increase the off-time and decrease the afterflow time if the plunger surfaces in the slow window and if the plunger fails to surface during an on-time, then additional off-time is added to allow for pressure build-up. The above represent the basic technique. Where the additional tank valve 72 is employed, an allowance is made for emergency venting to tank if abnormal operating conditions exist. Additionally, override capability will be seen made possible where sales line pressures as monitored, for example, at switch gauge 60, exceed a predetermined threshold representing a normal operating condition. Finally, shut-in capability is programmable where consecutive no-arrival runs or slow runs are encountered. A complete control over the operational program can be made by operator access to the keypad 112 at the location of the well.

In the discourse to follow, four counters will be referred to having the functions as follows:

Counter A: This counter counts how many occurrences the plunger has run at a rate representing a good window.

Counter B: This counter will count the number of occurrences in which the plunger has run at a rate representing a fast window.

Counter C: This counter will count how many occurrences the plunger has run at a rate representing a slow window.

Counter D: This counter will count the number of occasions in which the plunger has not arrived at the well head within the on-time interval.

Two delays are employed with the program:

Delay 1: This delay, having the typical time, for example of 5 minutes, is invoked in the event that the sales line pressure experiences an excursion causing contacts of switch gauge 60 to close to develop a high line contact signal.

Delay 2: This delay is selected as one component of afterflow time which represents an extension of on-time occasioned with improving well performance.

The control program also adjusts the operating parameters of the well through the use of factors which, in effect, are multiplying coefficients. The factors described are as follows:

Factor 1: This factor is utilized in establishing a decrement value for adjusting afterflow interval.

Factor 2: This factor is utilized in developing an interval of time for increasing the off-time provided by the sales valve 48.

Factor 3: This factor is utilized in increasing the off-cycle time in conjuction with operation of the system during a tank cycle employing tank valve 72.

Factor 4: This factor is utilized during the tank cycle for the purpose of decreasing afterflow time.

The above four factors are utilized in conjunction with two steps which are increments of time selected by the operator. The two steps described herein are as follows:

Step 1: This step is a time increment employed to carry out a gradual decrease of the off-cycle time interval.

Step 2: This step is a time increment employed for the purpose of increasing the interval of afterflow.

Figure 3B:
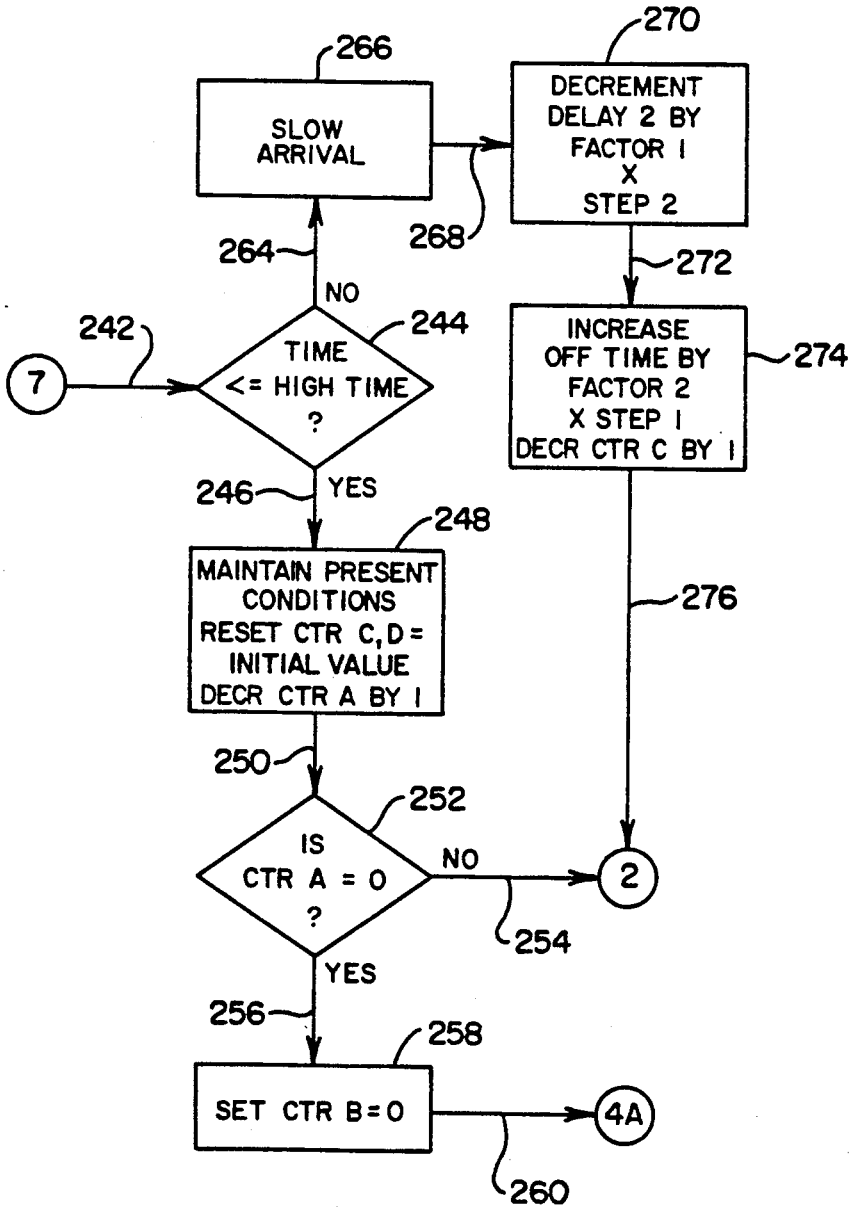

FIGS. 3A and 3B combine to illustrate the on-cycle or on-state of the instant process, the two figures being associated by a node 7. Looking to FIG. 3A, the on-cycle program is seen to commence with node 1 and line 120 leading to decision block 122. At this juncture, the program determines whether an MSO contact or plunger arrival signal has been received as developed by plunger detector 86. In the event of an affirmative determination, plunger 22 will be at the well head and the program continues as represented at line 124 and node 5A. Node 5A reappears in FIG. 4. Looking to that figure, there is shown program continuance as represented at line 126 and block 128. Block 128 indicates that the well is shut-in and that a plunger error 1 (EPL1) is present. This represents a failure that a plunger may possibly be stuck at the lubricator because of sand or other causes. To avoid permitting the program to continue an on-cycle, the well is shut in and this very special plunger error, specifically identified by the number 1 with it, is flashed at the display 110. Block 128 also indicates that present conditions are maintained. In this regard, the parameters as then exist for controlling the well are maintained for a subsequent visit to the well location by the operator, correcting the plunger condition and restarting the well essentially where it left off.

Figure 4:
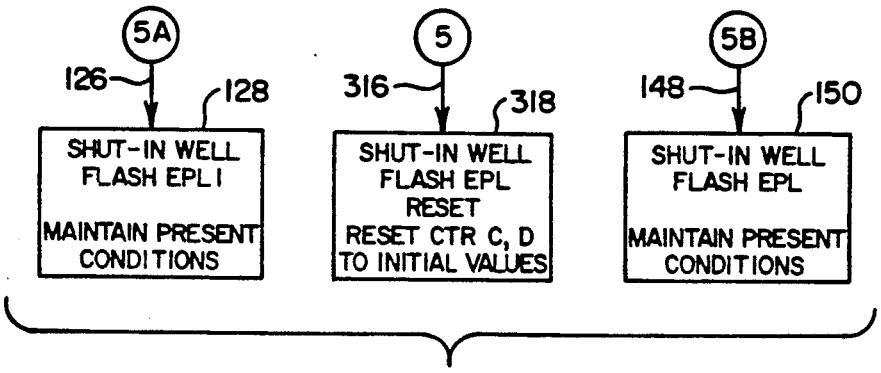
FIG. 4 is a flow chart component depicting shut-in default responses.

Returning to FIG. 3A, in the event that an MSO contact is not present, then as represented at line 130 and block 132, the timer of the software is set to the on-time and the sales valve (SV) 48 is opened. This on-time is determined by the operator during on-location analysis and remains constant during the controlling cycles. The program then continues as represented at line 134 and block 136 to determine whether the timer has decremented to zero. In the event that it has not and the on-cycle is continuing, then as represented at line 138 and block 140, a determination is made as to whether a plunger arrival (MSO) signal has been received. In the event that it has, then the plunger 22 will have reached the well head 14 and, as represented at line 142 and block 144, a determination is made as to whether the operator has set the catcher 38 to entrap the plunger 22 at wellhead 14. This will have been carried out when the operator has determined that an inspection and/or repair of the plunger is in order. To assure that the well does not continue to cycle with plunger 22 in this entrapped state, with an affirmative determination at block 144, as represented at line 146 and node 5B, the program performs as represented in FIG. 4. Looking momentarily to that figure, it is seen that node 5B again appears in conjunction with line 184 and block 150. In this regard, the well is shut-in, no further cycling taking place, and the conditions as of the time of plunger capture including the states of counters and any then-existing off-times or delay times, or afterflow times are maintained.

Returning to FIG. 3A, where the catcher has not been set, then as represented by line 152 and block 154, a determination is made as to whether the time required from the commencement of off-time until the time of plunger arrival as detected at proximity device 86 has a value less than an operator designated low-time. Thus, the program commences to determine the rate of travel or speed of the plunger approaching well head 14. The "low-time" will be determined by the operator in conjunction with selection of on-cycle or state time. For example, if an on-cycle time were selected as 20 minutes, then, the value for low time might be 7 minutes and a fast arrival of the plunger would be within a window or interval ranging in values from 0 to 7 minutes. Accordingly, in the event of an affirmative determination that a fast arrival is at hand, then as represented at line 156 and block 158, a determination is made as to whether the off-time or off-cycle time of the system has been adjusted to the point where it is at an operator selected minimum off-time. That minimum off-time, for example 30 minutes, is selected as being the minimum time adequate for the plunger 22 to return to the lower region of the well, for example adjacent the bumper structure 20. If the minimum off-time has not been reached by the control system, then as represented by line 160 and block 162, the control system responds to the fast cycle by decrementing counter B by 1, it being recalled that counter B is an operator designated count for an acceptable number of fast arrivals. Next, counters C and D are reset to their initial values, it being recalled that counter C is a count limit for the number of times the plunger arrives in a slow window and counter D counting non-arrivals. Using the above example for a 20 minute on-time, the slow window may be selected with respect to a high time of 14 minutes to provide a window of values ranging from 14 minutes to 20 minutes. Inasmuch as the well is operating very well, counters C and D are reset to their maximum values. Next, the off-time or off-cycle interval is decremented or reduced in extent by one step 1. As noted above, step 1 will be an increment of time selected by the operator, for example 5 minutes. Following this decrementing of off-time, as represented at line 164 and block 166, a determination is made as to whether counter B has been decremented to a zero value. In the event that it has not, then as represented at line 168 and node 2, the program progresses to an off-cycle.

Returning to block 158, where the off-time has been altered by the program to be equal to a minimum selected off-time, then as represented at line 170 and block 172, counter B, the counter monitoring the number of plunger arrivals during a fast time is decremented by 1, and as before, the slow and no arrival counters C and D are reset to their initial values. The off-time which is the minimum selected off-time is maintained and the program continues as represented at line 174 to the determination to be made at block 166 as to whether counter B has been decremented to a zero value. In the event that it has not, the program enters an off cycle. In this regard, node 2 and line 168 are seen to be repeated in FIG. 5, a flow chart representing the off-cycle sequence of control events. Looking to FIG. 5, 176, line is seen extending from node 2 to a branch block 178 where a determination is made as to whether counter C or counter D has been incremented to a zero value. Where either has not, then as represented at line 180 and block 182, the system timer is set to the elected off-time. This time may be, for the instant demonstration, equal to the minimum off-time as developed in conjunction with block 172 or it may be a decremented off-time as discussed in connection with block 162 of FIG. 3A. With the setting of the appropriate off-cycle time, either the sales valve 48 or the tank valve 72 is closed depending upon the call to this routine and the off-cycle time-out is commenced. The program continues then as represented at line 184 and block 186 to determine whether the timer has decremented to a zero value, where it has not, then as represented at line 188, and block 190, the timing is carried out with a decrementing of the off-counter. Additionally, the display 110 is updated with remaining off-cycle time each minute. The loop then continues as represented at line 192 and decision block 194, wherein a determination is made as to whether a DELAY1 flag has been set. This DELAY1 is provided as a predetermined interval, for example 5 minutes, and is utilized to accommodate for high pressure transients which may occur in the sales line gathering system and which will be detected by instrument 60. Instrument 60 will experience a contact make in the presence of such a high sales line or gathering system pressure and will experience a contact break at such time as that pressure diminishes to acceptable values. In the event that the DELAY1 flag is not set, then as represented at line 196, the timing loop continues as at line 184. Where the inquiry at block 186 determines that the off-cycle timing has decremented to zero, then as represented at line 198 and node 1, the control program returns to corresponding node 1 of FIG. 3A and line 120.

Returning to FIG. 3A, where a determination is made at block 166 that the decrementation of counter B, the counter representing fast arrival has reached a zero value, then as represented at line 200 and block 202, counter A is set to zero. This counter is representative of the number of times of arrival at a good rate or within a good window frame of time. Inasmuch as the control system will now progress to an afterflow control following the completion of the on-cycle, the setting of this counter to zero will provide for a desired non-incrementing selection of the DELAY2 or after flow time-out. Now looking to this DELAY2 or afterflow time-out, line 204 is seen to extend to node 4 which reappears in the DELAY2 or afterflow cycle represented by the flow chart of FIG. 6.

Figures 5, 6:
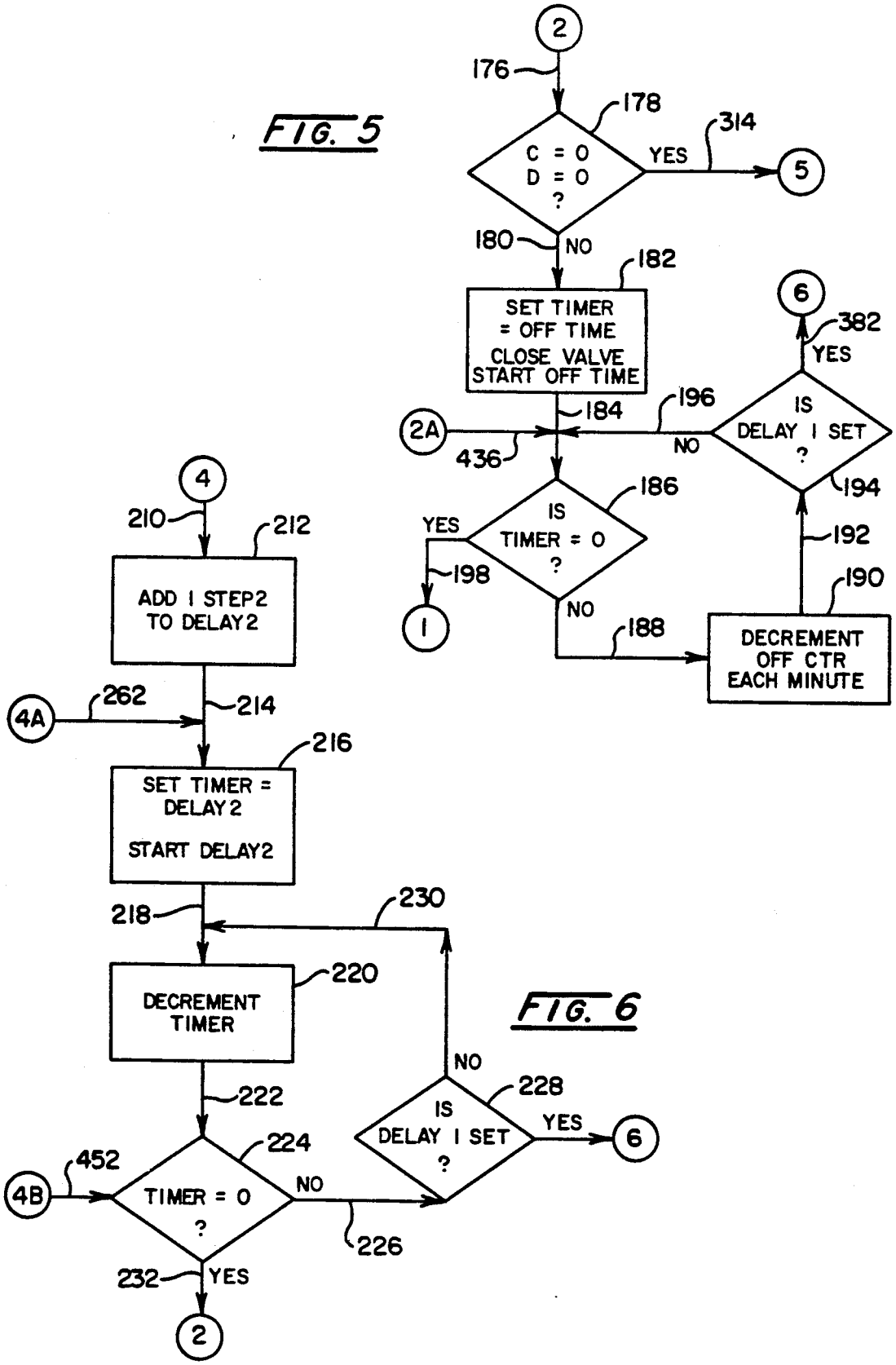
FIG. 5 is a flow chart showing an off-cycle component of the operating method of the invention.
FIG. 6 is a flow chart depicting an afterflow delay cycle employed with the method of the invention.

Referring to FIG. 6, line 210 extending from node 4 is seen to lead to the instructions at block 212 providing for the addition of one step 2 to DELAY2. Step 2 will be a time increment selected by the operator and the instructions thus serve to increment the afterflow time by that interval. The program then continues as represented at line 214 to the instructions at block 216 wherein the timer is then set to the DELAY2 interval and DELAY2 is commenced. Thus, the normal on-cycle time for sales valve 48 is extended for this revised interval of afterflow delay or DELAY2.

Timing is represented in the chart as commencing with line 218 and block 220, providing for the decrementing of the timer and, as represented at line 222 and block 224, a determination is made as to whether the timer has decremented to zero. In the event that it has not, then looping continues as represented at line at line 226. Line 226 extends to branch block 228 wherein a determination is made as to whether the earlier-discussed DELAY1 flag has been set. This DELAY1 will be seen to represent an increment of time selected to accommodate for excessively high pressure gathering system or sales line conditions. Where this DELAY1 has not been set, then as represented at line 230, timer looping continues to line 218. Upon timing out of the DELAY2 or afterflow interval, the control program proceeds to the off-cycle sequence of events as described in conjunction with FIG. 5. For this sequence, the valve closed in connection with block 182 will be sales valve 48.

Returning to FIG. 3A, and decision block 154, where the plunger 22 has arrived at well head 14 within the on-time and the time of its arrival is not less than the low time, then such arrival will be either within a good window or the rate of plunger rise will be slow. Accordingly, as represented at line 240, the program proceeds as directed by node 7 which reappears at FIG. 3B. Looking to FIG. 3B, line 242 is seen to extend from node 7 to the inquiry presented at block 244. At that position, a determination is made as to whether the time of arrival of the plunger is less than the threshold selected for high time. For example, the operator may select that period of an on-time of 20 minutes as being 14 minutes. Thus, where the determination is in the affirmative, as represented at line 246 and block 248, the plunger rate of movement will correspond with a good window of time. As set forth at block 248, the present control conditions are maintained for this good window and counters C and D are reset to their initial values in view of the appropriate arrival of the plunger. Additionally, counter A, representing the number of occurrences of the arrival of plunger 22 at the wellhead 14 within this good window of time is decremented by 1. The program then continues as represented at line 250 and block 252 wherein a determination is made as to whether, following the decrementation instruction at block 248, the counter A is now at zero. In the event it is not at that zero value, then as represented by line 254 and node 2, the off-cycle is commenced as described in conjunction with FIG. 5. In the event that counter A has been decremented to zero, then as represented at line 256 and block 258, counter B, representing the fast window counter, is set to zero to assure that the system will go to delay or afterflow time in the event of a subsequent fast arrival. Accordingly, following the setting of counter B to zero, as represented by line 260 and node 4A, the program diverts to the delay to or afterflow cycle. Looking again to FIG. 6, it may be seen that node 4A reappears in conjunction with line 262 leading to line 214. Thus, for the presence of a select number of movements of plunger 22 at a good speed, the afterflow is undertaken but without incrementing the delay as described at block 212 in conjunction with a fast rate of plunger arrival.

Returning to FIG. 3B, where the plunger 22 arrives at wellhead 14 within the slow window of time, for example, between 14 and 20 minutes for the exemplary times given above, then the plunger time will not be less than the operator selected high time but will have arrived within the on time and, as represented at line 264 and block 266, a slow arrival will have been determined. The program then continues as represented at line 268 and block 270, where the DELAY2 or afterflow interval of time is reduced or decremented by a factor 1 times step 2. That factor and step are selected by the operator as part of the overall program. However, the amount of afterflow is decreased in view of this slow arrival. The program then continues as represented by line 272 and block 274 providing instructions for increasing the off-cycle time by a factor 2 times step 1. Thus, more time is given for the off-cycle interval to build requisite pressure. Additionally, counter C, that counter having an operator programmed number of permissible slow arrivals is decremented by 1 and, as represented by line 276, the program progresses to node 2 and the off-cycle associated therewith as described in conjunction with FIG. 5.

Returning to FIG. 3A, a timing loop associated with inquiry blocks 136 and 140 is shown to include line 278 representing a negative determination as to plunger arrival at block 140, as well as the decrementing to zero of timer 136. Accordingly, where the timer has not decremented to zero and the plunger has not arrived, the path represented by line 278 is seen to extend to the instructions at block 280 providing for the decrementing of the timer. The timing loop then continues as represented at line 282 to the inquiry at block 284 where, as before, a determination is made as to whether the DELAY1 flag has been set. This delay, as before, is predicated upon the presence of a high line signal as developed at instrument 60. Where the delay flag is not set, then as represented at line 286, the timing loop continues.

Where the inquiry at block 136 as to whether the timer is decremented to zero is in the affirmative, then as represented at line 288 and block 290, counters A and B, representing respectively predetermined counts of plunger arrivals in a good window and in a fast window are set to their initial values and the sales valve 48 is closed. The program then continues as represented by line 292 and node 3.

Figure 7:
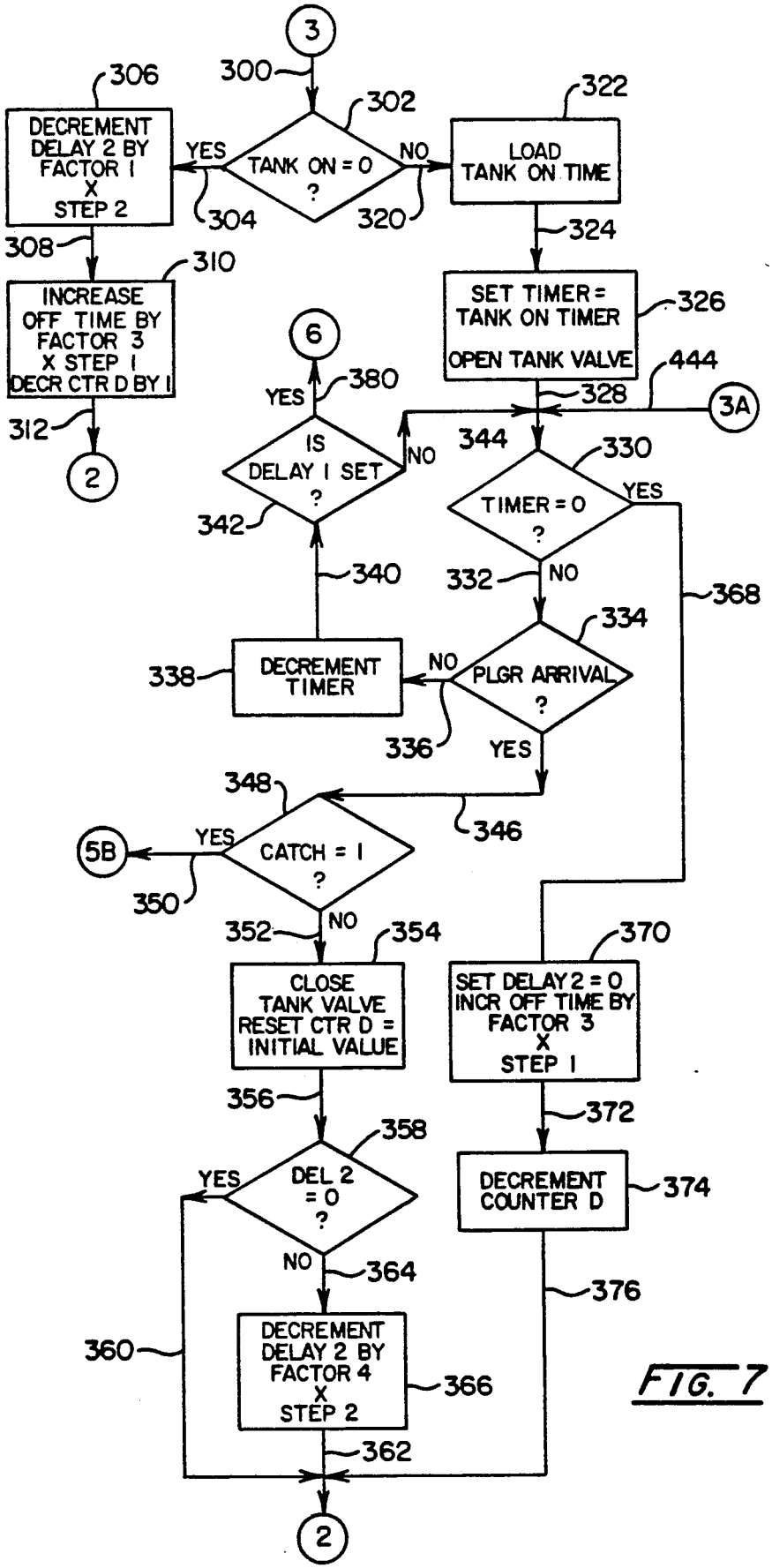
FIG. 7 is a flow chart showing a tank cycle employed with the well operating method of the invention.

Referring to FIG. 7, node 3 is seen to commence a tank cycle under a well facility structuring wherein tank valve 72 generally is present. On the other hand, corrective procedures also are undertaken where the installation does not include that valve. In the figure, line 300 is seen extending from node 3 to the inquiry presented at block 302. That inquiry determines whether or not tank valve 72 is present by a determination as to whether the tank flag or "tank on" is zero. Where that is the case, then as represented by line 304 and block 306, the DELAY2 or afterflow interval is decremented by an operator selected factor 1 multiplied by a time increment such as step 2. For example, step 2 may have a value of 5 minutes and factor 1 may have a value of 2. Thus, an afterflow, for example, of one hour would be reduced by 10 minutes. The program then progresses as represented at line 308 and block 310 wherein the off-cycle time is increased by another factor 3 multiplied by a step 1. Thus, for example, where the step 1 is set by the operator at 5 minutes and factor 3 has a value of 12, the off-time would be expanded by 60 minutes. Additionally, note that counter D, representing a predetermined count for no arrival condition is decremented by 1 and as represented at line 312 and node 2, the control program proceeds to an off-cycle routine as described earlier in conjunction with FIG. 5. Looking momentarily to that figure, it may be seen that the inquiry at block 178 determines whether or not counter C has decremented to zero or counter D has decremented to zero. Thus, if the decrementation of counter D as represented at block 310 has brought that counter to a zero value, the program would divert as represented at line 314 and node 5 to a shut-in procedure. Similarly, it may be recalled from FIG. 3B, where counter C has been decremented as a result of a slow plunger arrival, a similar access to node 2 of the off-cycle is made. Where either of these counters has reached zero, the shut-in default procedures are accessed. Looking again to FIG. 4, it may be seen that node 5 reappears in conjunction with line 316 leading to block 318. For this condition of failure, the well is shut-in and the letters "EPL" representing plunger error are flashed at display 110. Additionally, counters C and D are reset to their initial values.

Returning to the tank cycle of FIG. 7, where a tank valve as at 72 is present, interconnected essentially to atmospheric pressure as represented by tank 76 or to a low pressure sales line, then the tank cycle proceeds as represented by line 320 and block 322 wherein the tank operator selected tank on-time is loaded. Then, as represented at line 324 and block 326, the timer is set to equal the tank-on-timer and the tank valve 72 is opened. The program then proceeds as represented at line 328 and block 330 wherein an inquiry is made as to whether the tank timer is at zero. If it is not, then as represented by line 332 and block 334, a determination is made as to whether the plunger 22 has reached wellhead 14, albeit following the time-out of the on-cycle. In the event of a negative determination, then looping continues as represented at line 336 and block 338 where the tank-on-timer is decremented. The control procedure then continues as represented at line 340 and block 342 wherein a determination is made as to whether the DELAY1 flag has been set. This checks to see whether, for the condition of connection with a low pressure sales line, that low pressure sales line would have experienced a high pressure or high pressure excursion. In the event of a negative determination at block 342, then as represented at line 344, the tank cycle timing loop continues to line 328.

Where the determination at block 334 is that the plunger 22 has arrived at wellhead 14, then as represented at line 346 and block 348, a determination again is made as to whether the catcher 38 has been actuated by the operator to arrest the plunger. Under this condition, the plunger will be trapped at the wellhead and the program continues as represented at line 350 and node 5B providing for a shut-in procedure as described earlier herein in conjunction with FIG. 4. Where the plunger has not been purposely caught, then as represented at line 352 and block 354, the tank valve 72 is closed and the no arrival counter D is reset to its initial value. The procedure then continues as represented at line 356 and decision block 358 wherein a determination is made as to whether the afterflow DELAY2 has been made equal to zero. In the event it has, then as represented at lines 360, 362, and node 2, the control proceeds to an off-cycle as described in conjunction with FIG. 5. Where the DELAY2 is not equal to zero, then some afterflow interval has remained in effect, and as represented at line 364 and block 366, the DELAY2 is decremented by a factor 4 multiplied by a step 2 which reduces it to an extent desired by the operator during the programming of the controller 50.

Where the tank cycle has timed out as developed by an affirmative determination at block 330, then as represented by line 368 and block 370, the afterflow or DELAY2 interval is set equal to zero and the off-time is incremented by a factor 3 multiplied by a step 1 which may be of significant total value in terms of time. The program then proceeds as represented at line 372 and block 374 to increment counter D representing a no arrival and, as represented at lines 376, 326, and node 2, the tank cycle exits to undertake an off-cycle as described in conjunction with FIG. 5.

Figure 8:
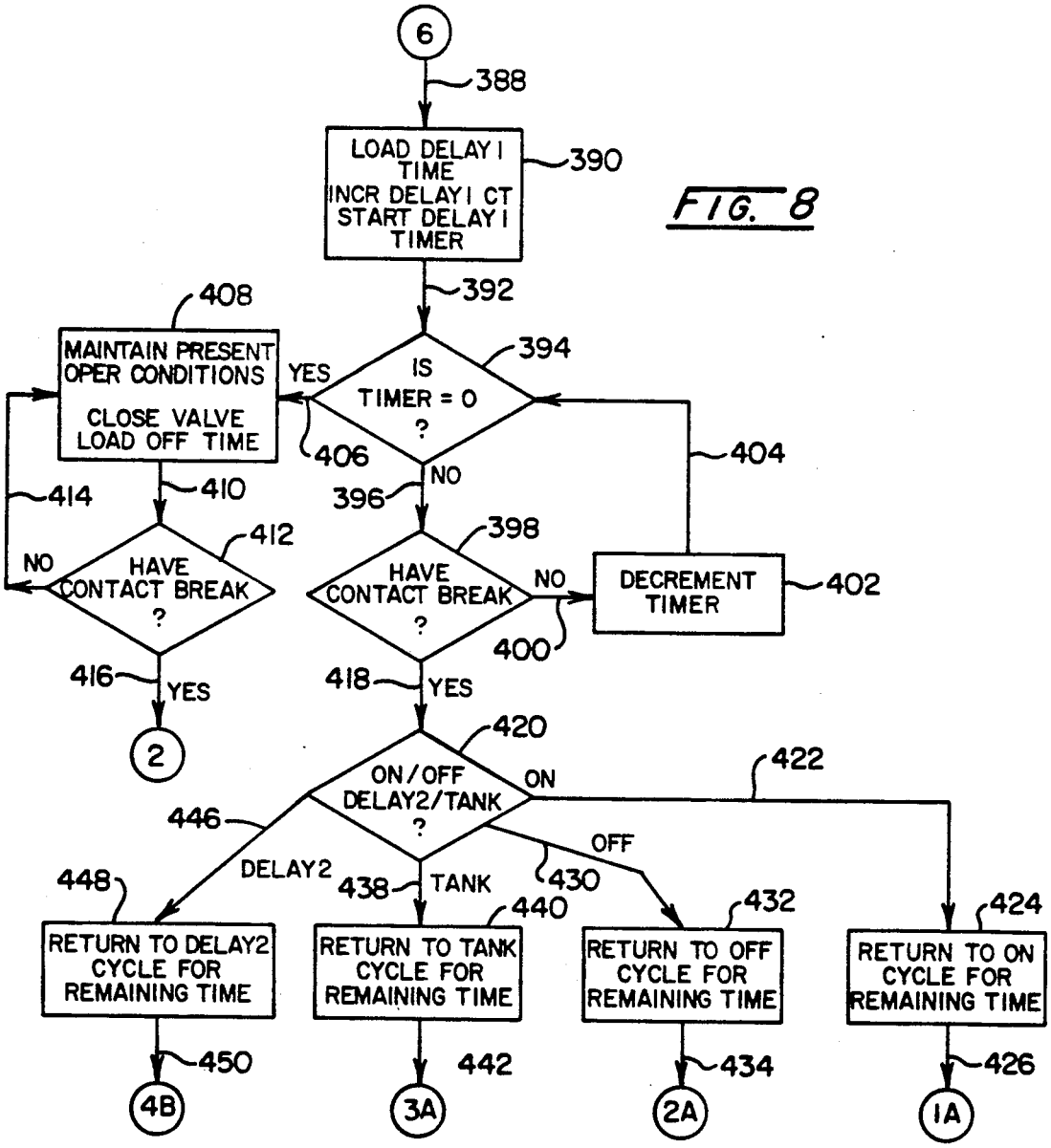
FIG. 8 is a flow chart showing a high line delay feature of the method of the invention.

Now considering the DELAY1 cycle in more detail, it may be noted in FIG. 7 that where the inquiry at decision block 342 is in the affirmative, then as represented at line 380 and node 6, the DELAY1 cycle is entered. Similarly, in FIG. 5, where the inquiry at block 194 is in the affirmative, as represented at line 382 and node 6, the same DELAY1 cycle is entered. Also, as shown in FIG. 3A and block 284, an affirmative determination that the DELAY1 flag is set provides, as represented at line 384 and node 6, that this delay cycle is entered. Looking to FIG. 8, node 6 is seen to reappear in conjunction with line 388 which, in turn, is directed to block 390. Instructions provided at block 90 look to the loading of the DELAY1 time which, for example, may be five minutes. A DELAY1 counter then may be incremented and the DELAY1 timer may be started. In general, this DELAY1 time value will be selected to accommodate a higher pressure surge which may occur with the opening of sales valve 48. The additional increment of time maintaining an open condition will permit a transient pressure condition to bleed down or diminish below the threshold, for example of instrument 60. The routine then progresses as represented at line 392 and block 394 to determine whether the DELAY1 timer has decremented to zero. In the event that it has not, then the program proceeds as represented at line 396 and block 398 to determine whether a contact break has been witnessed at instrument 60. This will mean that the pressure within the line has diminished. In the event of a negative determination at block 398, then as represented at line 400 and block 402, the DELAY1 timer is decremented and the timing procedure loops as represented by line 404.

In the event that the DELAY1 timer has timed out, an affirmative determination will have been made at block 394 and, as represented at line 406 and block 408, the parameters or conditions of the program are maintained and the valve 48 or 72 pertinent to the call to this routine is closed. Additionally, the off-time is loaded into the system timer. This arrangement is provided, for example, to accommodate such conditions as a compressor failing within the sales line which may take many hours or more than a day to repair. Under the circumstances, the parameters are maintained and the well is preserved by going to an off-time condition. The instant routine then continues as represented at line 410 and block 412 where a determination is made as to whether a contact break has been experienced at instrument 60. Where that is not the case, then the routine loops as represented at line 414. On the other hand, an affirmative determination at block 412 representing a reduction of sales line pressure provides for a control path including line 416 and node 2. Node 2 leads to the off-cycle as described above in conjunction with FIG. 5.

Where a contact break is determined to have occurred in conjunction with decision block 398, then as represented at line 418 and block 420, a determination is made as to which component of the control program has called this DELAY1 routine. A determination is made through the expedient of setting a flag within the program language as to where the call for this delay procedure was made. In the event it occurred from the on-cycle as at line 384, then as represented at line 422 and block 424, instructions are made to return to the on-cycle for the remaining on-cycle time. Thus, the program continues as represented at line 426 and node 1A. Looking momentarily to FIG. 3A, it may be observed that node 1A reappears, introducing line 428 leading to the inquiry at block 136 within the timing loop.

Returning to FIG. 8, where the call for the DELAY1 routine is from the off-cycle, then as represented at line 430 and block 432, the program returns to the off-cycle for the time which may remain. The routine then is seen to progress as represented by line 434 to node 2A which reappears in FIG. 5. Looking momentarily to FIG. 5, node 2A is seen to introduce line 436 to the off-cycle timing loop as at line 184.

Returning to FIG. 8, where the determination at block 420 is made that the DELAY1 routine has been called from the tank cycle, then as represented at line 438 and block 440, the program returns to the tank cycle for the tank cycle remaining time interval. This activity is represented at line 442 extending to node 3A. Looking momentarily to FIG. 7, it may be observed that node 3A reappears in conjunction with line 444 leading to the tank timing loop as at line 328.

Returning to FIG. 8, where the determination at block 420 is that the DELAY1 routine has been called from the DELAY2 routine, then as represented at line 446 and block 448, the routine returns to the DELAY2 cycle for the time remaining within the DELAY2 timeout. In this regard, note that line 450 extends from block 458 to node 4B. Looking momentarily to FIG. 6, node 4B reappears in conjunction with line 452 extending to the delay to timing loop at block 224.

Figure 9:
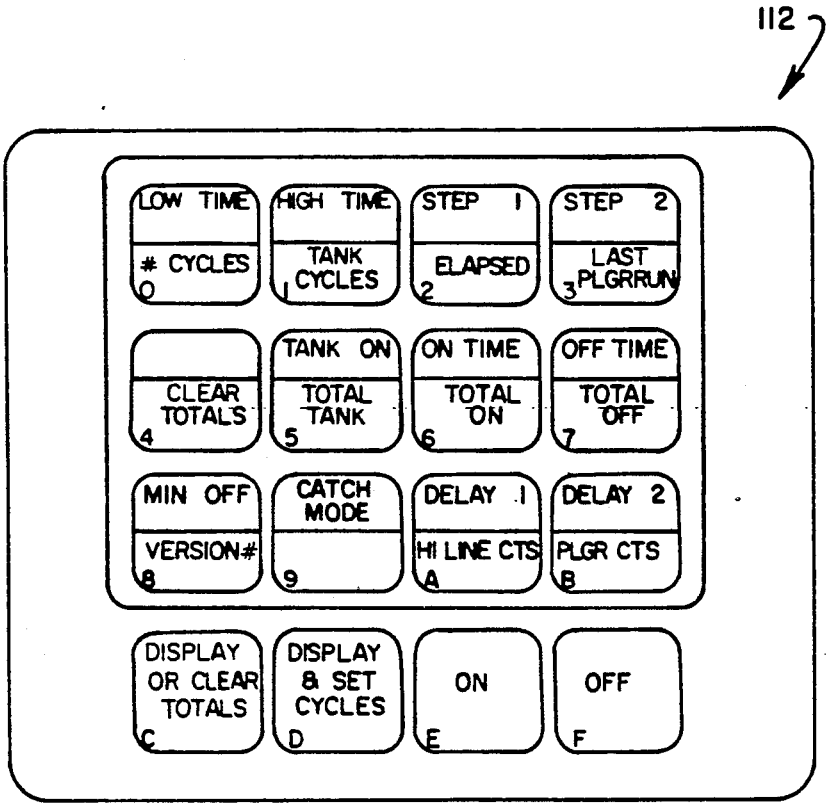
FIG. 9 is an enlarged view of a keypad employed with the controller of FIG. 2.

Looking to FIG. 9, the keypad 112 is revealed at an enhanced level of detail. This keypad has the same general structuring and number of keys as the earlier-described Liquilift controller products. However, the keypad 112 has been customized to the control program described above. Looking to the figure, the on and off buttons which, respectively, are labeled E and F carry out the conventional function of providing a manual override to the operator at the location of the well. For example, by pressing the on button, the well will immediately undertake and on-cycle or state and, conversely, pressing the off button will cause the well to immediately assume an off-cycle or state. When programming the controller 50, generally the nominal on-time for the well will be set by the operator, for example, at 30 minutes. This is carried out by pressing the D button then on-time button number 6 and then loading the desired 30 minutes. Following this loading of the desired on-time, either the C or D buttons are pressed to enter the value. The on-time value is never decremented or incremented in the program. This permits the windows defining plunger fast, slow, and normal arrival to remain consistent and leads to an improved well production procedure.

The plunger arrival windows then are set by the operator based upon judgment of well performance. For example, if a fast arrival would be within the first 12 minutes of the on-time, then the operator presses the D button, followed by depressing the load time or zero button; the loading of 12 minutes, and the pressing of the D button to enter that amount. Next, a high time is selected by the operator, for example such as 20 minutes, within a 30 minute on-time. To enter the high-time, the D button is pressed, followed by the pressing of button number 1 and the loading of a 20-minute value with the numbered buttons. That value then is entered by depressing the C or D buttons or keys. Thus, there is set-up a fast plunger rate between zero minutes and 20 minutes; a good window between 12 and 20 minutes, and a slow window between 20 minutes and 30 minutes. Of course, the above values can be displayed by simply pressing the D button followed by depressing the appropriately labeled button or key.

The initial value off-time elected by the operator is selected by depressing button or key D following which button or key number 7 is depressed to display the then-present off-time. A value then may be entered by the operator using the numbered keys and entry is provided by depressing key or button C or D. Should the plunger 22 run within the noted good window of time, then the off-time in general will not change. The minimum off-time is accessed by depressing key D then key number 8 to display the current value. The minimum off-time is based upon knowledge of the time required for the plunger 22 to fall back to the bottom or lower region of the well. Accordingly, the program will not diminish off-time below that minimum value. The decrementing of off-time in the presence of fast arrivals will discontinue when the minimum off-time is reached.

The decrementing and incrementing of time components as described in conjunction with FIGS. 3A, 3B, 6, and 7 is carried out in conjunction with buttons 2 and 3. In this regard, by depressing key D followed by the pressing of either buttons 2 or 3 for respective steps 1 and 2, values can then be loaded using the numerical key designations. Entry is by depressing either key C or D. These steps in general operate with factors which are pre-programmed but can be changed or accessed by the operator. Factors 1–4 are accessed by the respective second row buttons 4–7. Should the operator desire to change or review those factors, button C is depressed followed by the depression of button D and an appropriate one of keys 4–7. Thus, a factor is multiplied by a step to develop an incrementing time. For example, should step 1 be assigned a 5 minute increment, and factor 3 a value of 24, then two hours, would be added to the off-time for a plunger no arrival condition in the tank cycle block 310 at FIG. 7. The program maintains a cumulative total of the number of cycles carried out, the number of tank cycles, the number of plunger arrivals, the total tank on-time, the total on-time, the total off-time, the number of high sales line occurrences or counts, and the time elapsed since the last clearing of the system. This latter clearing is carried out with respect to button number 4. By pressing button C then button number 4, the totals can be cleared. Correspondingly, by pressing button C then button 0, the number of cycles since the last clearing are displayed. By pressing button C then button 1, the number of tank cycles occurring since the last clearing are displayed. By pressing button C, then button 2, the total elapsed time since the last clearing is displayed. By pressing button C, then button 3, the length of time required for the last plunger run is displayed. By pressing button C followed by the depressing of button 5, the total tank time is displayed. Note that there is no tank off-time, inasmuch as it is not part of the control scheme. The total on-time is accessed by pressing button C followed by the depression of button 6 and the total off-time, similarly, is accessed by pressing button C followed by the depression of button 7. By depressing button C followed by the depression of button A, the number of high line counts or pressure excursions witnessed by instrument 60 since the last clearance is displayed and by depressing button C followed by the depression of button B, the corresponding number of plunger arrivals or counts since the last general clearance are displayed. Because the software control may be altered, the version existing at a particular controller is displayed by depressing button C followed by the depression of button number 8.

DELAY1 and DELAY2 value smay be inserted by the operator by depressing button D, then respective buttons A or D. The controller will display the current delay values which may be altered by pressing the numerical keys. Following the loading of any altered values, the new delay values are entered by depressing button C.

A catch mode is provided for the convenience of operators in field. Often, the operator will wish to examine or maintenance the plunger and must time an arrival at the well location so as to be there at the appropriate point in time during an on cycle. This can be a highly inconvenient situation. Additionally, should the catcher entrap the plunger and for some reason the operator is unable then to reattend the well, considerable difficulties might ensue without an accommodation. The catch mode is entered by depressing button D, then button 9 and the program will respond to the next plunger arrival as occurring under catch conditions and will protect the well.

Figure 10:
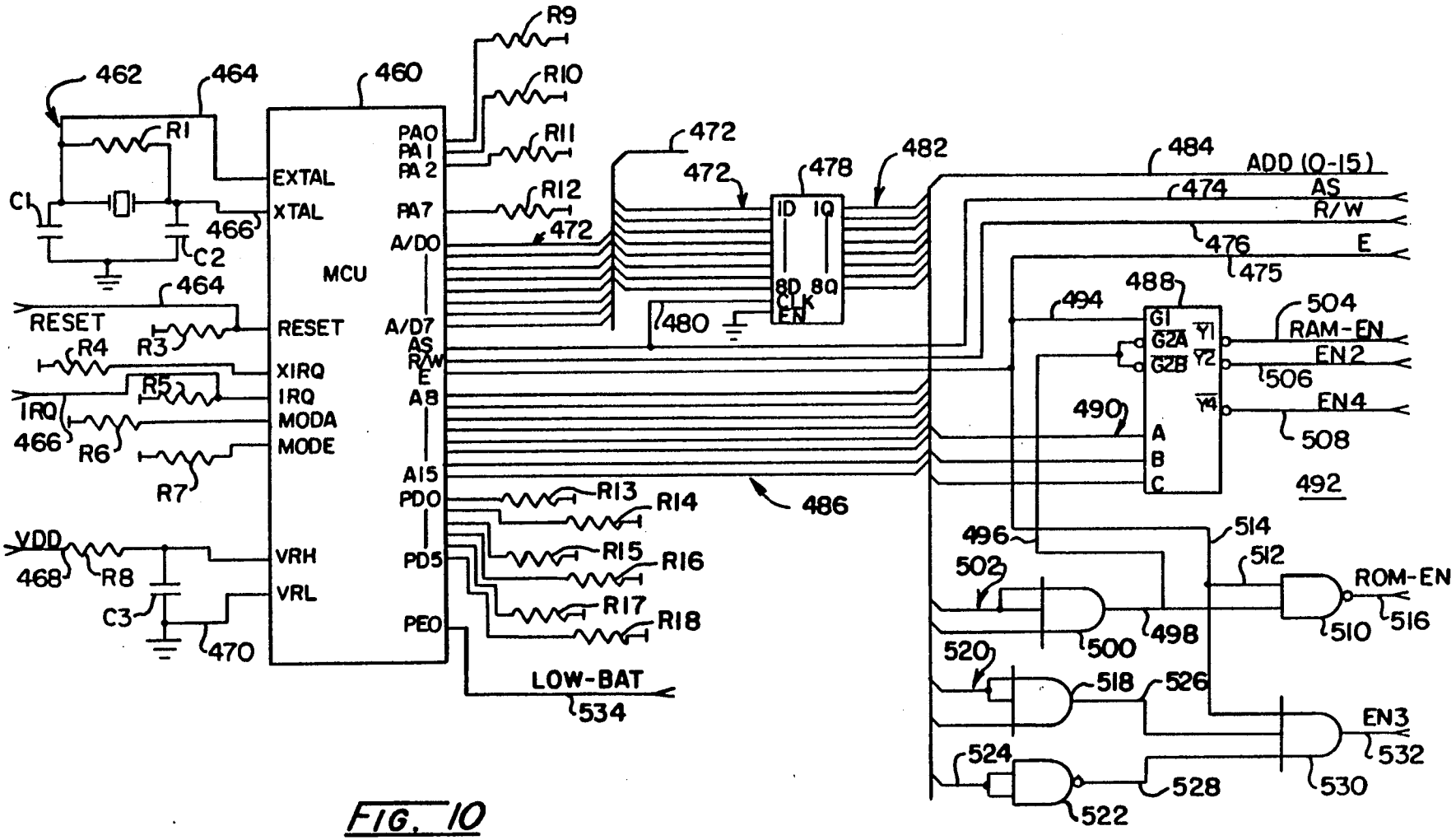
FIG. 10 is a schematic diagram of a control circuit used with the controller employed with the invention showing microcontroller and decoder features.

While a complete description of a circuit for driving a controller as at 50 has been described in the above-referenced Norwood U.S. Pat. No. 4,352,376, that circuit over the years has been updated and its current version is illustrated herein in conjunction with FIGS. 10–14. Referring to FIG. 10, the microcontroller-based components of the newer circuit are represented. In the figure, an 8-bit microcontroller unit (MCU) is represented at 460. Device 460 may be provided, for example, as a type MC68HC11 marketed by Motorola, Inc. The device is a high density CMOS microcontroller containing on-chip peripheral capabilities including an 8-channel, 8-bit A/D converter, static random access memory (RAM), interfacing features, and real time interrupt logic. The device performs in conjunction with a crystal-driven oscillator circuit 462 applying a 4 MHz crystal in conjunction with two stabilizing capacitors C1 and C2 and an impedance matching resistor R1. The resultant input to the corresponding EXTAL and XTAL terminals of device 460 are provided at lines 464 and 466. A non-maskable reset input to MCU 460 is provided to its RESET terminal from line 464 which, additionally, includes a pull-up resistor R3 coupled to voltage source VDD. The pull-up resistor is included inasmuch as the corresponding terminal of MCU 460 is of an open drain variety. The reset signal can emanate from a number of locations, including a power-up reset as described in conjunction with FIG. 13, external switches and the like. Below reset line 464 and also directed to the IRQ terminal and the interrupt logic of device 460 is a maskable interrupt or interrupt request line (IRQ) 466. Line 466 also is coupled with pull-up resistor R5 coupled to VDD for the noted open drain input requirements of device 460. A similar pull-up resistor as at R4, is provided at the unused $\overline{\text{XIRQ}}$ terminal, while pull-up resistor R6, and R7 are directed to respective terminals, MODA and MODB of MCU 460 to set it to rn in an expanded mode. A +5 v power supply (VDD) is directed to one analog-to-digital converter terminal VRH of MCU 460 via line 468. This source is provided in conjunction with a low pass filter comprised of resistor R8 and capacitor C3. Line 470 connected with capacitor C3 also is directed to the reference input VRL for this A/D function. Resistors R9–R12 additionally are pull-up resistors coupled with unused address or capture ports within the PA0–PA7 grouping of device 460 and are required in view of the open drain configuration of those inputs. Immediately below that grouping of resistors are the lead arrays of a multiplexed addressed data bus (DATA0–DATA7) represented generally at 472 and directed to ports A/D-0–A/D7. Next, ports A3, R/W and E of MCU 460 are coupled, respectively, with lines 474–476 providing, in turn, respective address strobe (AS) and read/write (R/W) and enable (E) outputs. Bus leads DATA0–DATA7 of bus 472 additionally are directed to the 1D–8D inputs of an 8-bit latch 478. The clock input to latch 478 is asserted from lines 480 and 474 and the enable port thereof is coupled to ground. The 1Q–8Q outputs of the latch are presented at lead array 482 of a 16-bit address bus 484. Array 482 includes the lower address lines ADD0–ADD7, the upper address lines ADD-8–ADD15 being represented by lead array 486 and coupled to the corresponding A8–A15 ports of MCU 460. In operation, the address data are first written to the lower address line following which an address strobe is asserted. The non-multiplexed address leads ADD8–ADD15 are represented at array 486 extending to bus 484. A three line grouping of this array 486 is directed to the A,B, and C terminals of a 3-to-8 decoder 488 via three-line lead array 490. Device 488, which may be provided, for example as a type 74HC138, functions as part of a decoding network represented generally at 492. The G1 input to decoder 488 receives the enable (E) signal from MCU 460 via line 494, while the $\overline{G2A}$ and $\overline{G2B}$ terminals simultaneously receive an input via line 496 which, in turn, extends to line 498 which is the output of an AND gate 500, the inputs to which are provided from dual leads 502 of address bus 484. Selected outputs from decoder 488 are a RAM enable (RAM EN) at line 504 and enable output (EN2) at line 506 and another enable output (EN4) at line 508. Of the decoding network 492, it may be observed that line 498 extends to one input of a NAND gate 510, the opposite input to which is developed from lines 512 and 514, the latter extending to enable (E) line 475. The low true or active output of gate 510 at line 516 provides a read only memory enable low true signal (ROM EN). Gates 500 and 510 as so connected, function to isolate decoder 488 by virtue of the signal asserted from line 498 and 496 during such time as an enable signal is presented at line 516.

Additionally within network 492 is an AND gate 518 which is coupled to two leads 520 from bus 484 and NAND gate 522, the inputs to which are coupled to one lead 524 of bus 484. The respective outputs of gates 518 and 522 at lines 526 and 528 are directed to two inputs of three input AND gate 530. A third input to gate 530 is from line 514 carrying the enable (E) signal. The output of gate 530 which is active high, is utilized to provide an enable signal (EN3) directed, in turn, to the display 110. Additionally provided to the open drain inputs PD0–PD5 of the conversion components of device MCU460 are pull-up resistors R13–R18 and, additionally, one input port PEO is employed to receive a low battery signal from line 534.

Figure 11:
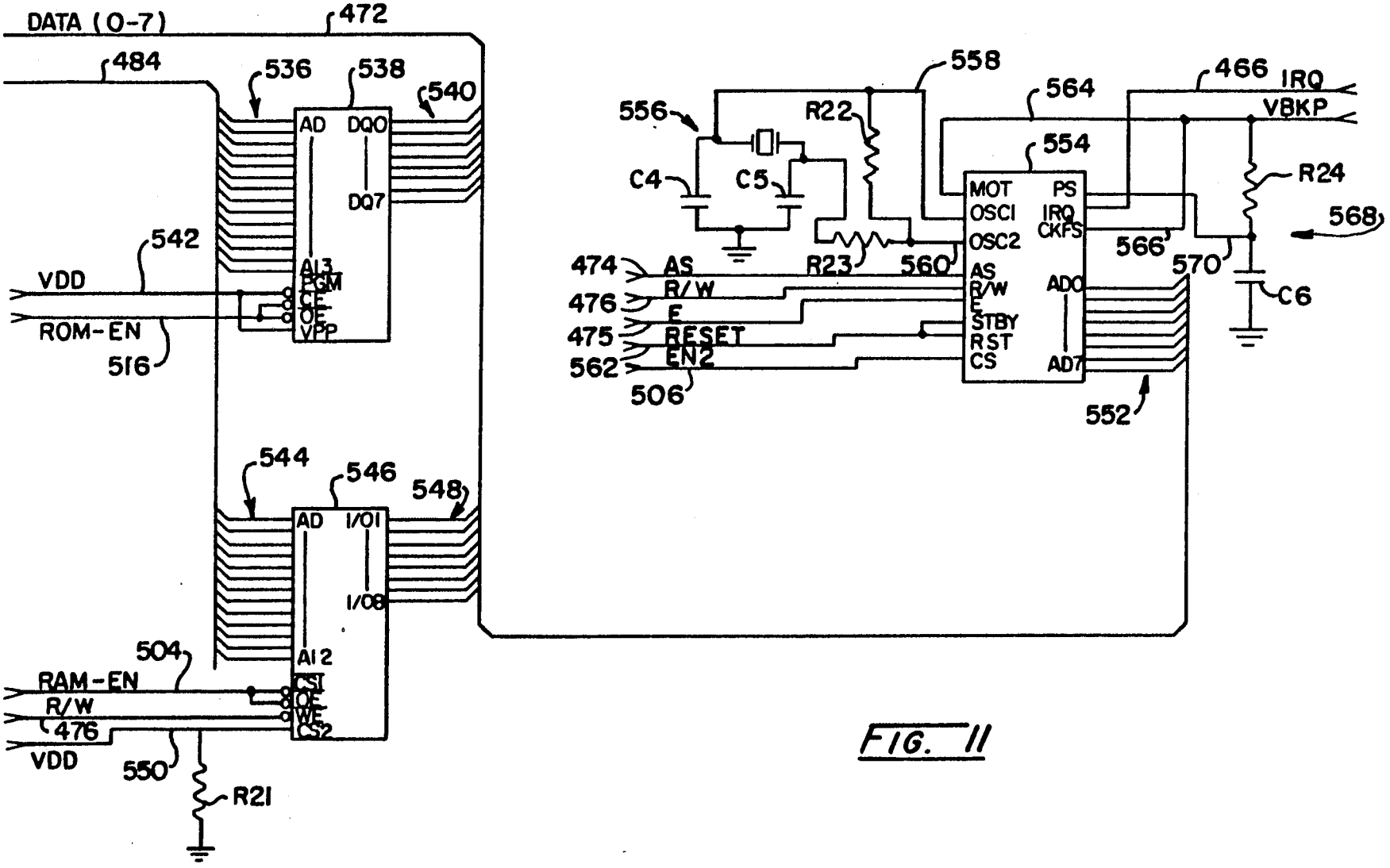
FIG. 11 is an electrical schematic diagram showing memory and calendar components of the circuit of the controller employed with the invention.

Referring to FIG. 11, the address bus 484 is seen to reappear having leads ADD0–ADD13 at lead array 536 directed to the corresponding A0–A13 address input ports of a 16K×8 UV erasable and electrically reprogrammable CMOS read only memory (EPROM) 538. The output of EPROM 538 at its DQ0–DQ7 ports is directed to 8-lead databus 472 through lead array 540. VDD power supply is provided to EPROM 538 from line 542, while an enable signal (ROM EN) is utilized to select the component via line 516 as described earlier in conjunction with FIG. 10. Device 538 may be provided, for example, as a type NMC27C128B marketed by National Semiconductor, Inc.

Leads ADD0–ADD12 of 16 lead address bus 484 are directed via lead array 544 to the corresponding A0–A12 input ports of an 8K×8 LSI static random access memory (RAM) 546, the input/output ports I/01–I/08 ports of which are coupled via lead array 548 to data bus 472. The chip select ($\overline{CS1}$) port of device 546 is enabled from the enable signal developed at line 504 as described in conjunction with FIG. 10, while the $\overline{WE}$ port thereof receives an R/W signal from earlier-described line 576. Finally, VDD power is supplied to the CS2 terminal thereof via line 550. A resistor R21 coupled to ground additionally is seen coupled to line 550 for the purpose of maintaining port CS2 at a lower level in the event of battery loss or the like. Device 546 may be provided as a type CDN6264 LSI static RAM marketed by RCA.

Databus 472 also is seen directed via lead array 552 to the AD0–AD7 input address ports of a real-time clock 554. Provided, for example, as a type 6818 A real time clock (RTC) marketed by Motorola Corporation, device 554 derives its time base from an oscillator network 556 including a 32 KHz crystal performing in conjunction with stabilizing capacitors C4 and C5. Resistors R22 and R23 of the network provide for impedance matching and the network is seen to be coupled with RTC 554 via lines 558 and 560. The address strobe (AS) input thereto is seen coupled to line 474; the R/W input thereto is seen coupled with line 476; the enable (E) input thereto is seen coupled with line 475 and the chip select (CS) is seen coupled to enable line 506, those input lines being derived from MCU 460 as described in conjunction with FIG. 10. Additionally, a reset input is provided via line 562. Device 554 provides an interrupt request as earlier-described in connection with FIG. 10 via line 466 and its power supply input including voltage back-up from a lithium battery is seen developed from line 564 which is directed to the MOT terminal thereof. Line 564 also is seen coupled to the CSFS terminal of device 554 via line 566 and to an RC network 568, the delay output of which extends via line 570 to the power sense (PSN) terminal of the RTC device 554. The latter input provides for a stabilizing delay on power-up.

Figure 12:
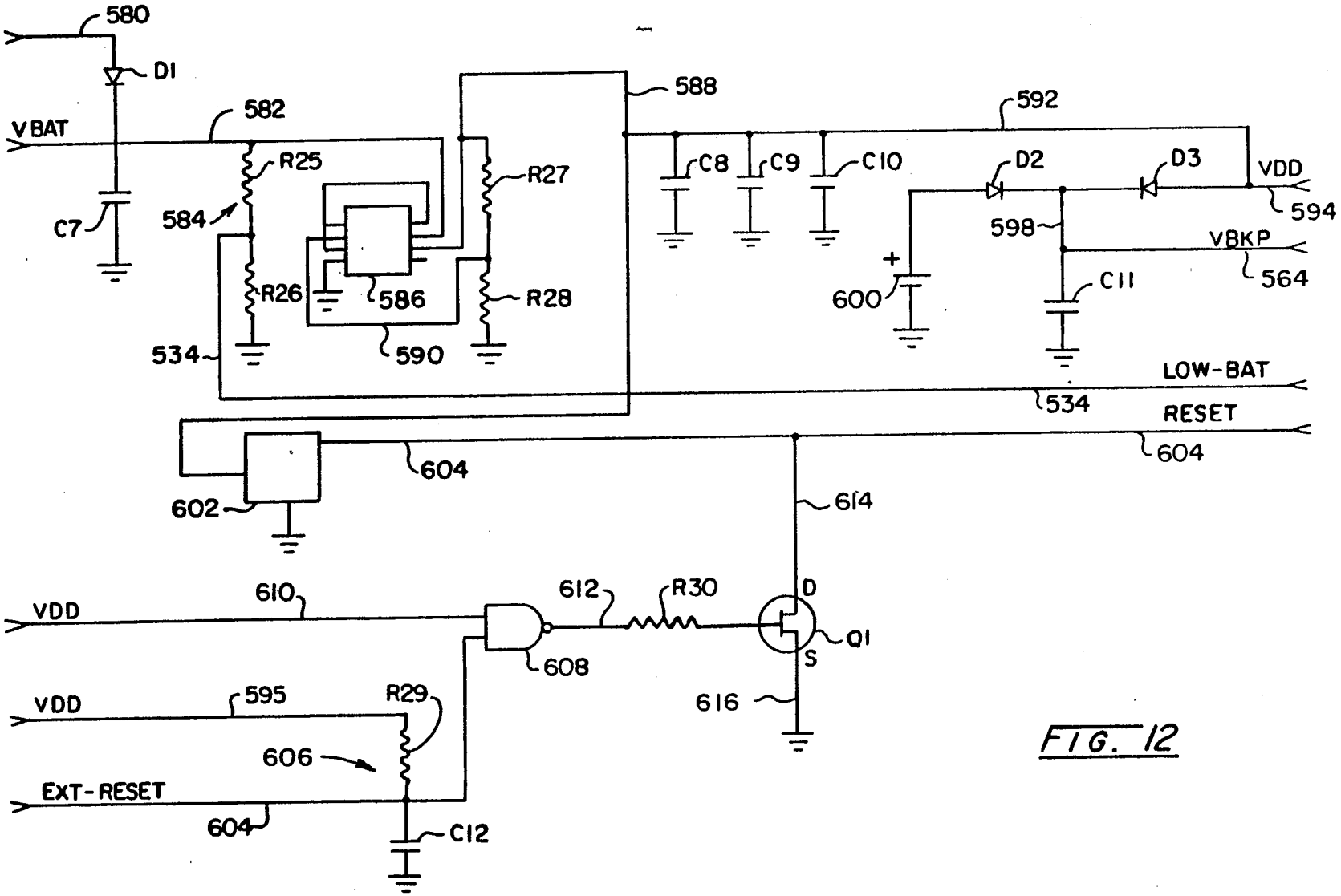
FIG. 12 is an electrical schematic diagram of the circuit of the controller used with the invention showing power supply and reset features.

Referring to FIG. 12, the voltage regulator components of the controller circuit are revealed. The controller 50 may be utilized in conjunction with a small solar panel as well as with conventional batteries. Where a solar panel is installed, the batteries may be of a solar rechargeable variety. Solar input to the voltage regulator circuit is applied at line 580 to be directed through blocking diode D1 to line 582. Correspondingly, voltage from the battery is supplied at line 582. A filter capacitor C7 is coupled to line 582 to filter any noise transients occasioned from battery or panel couplings. Tapping line 582 also is a voltage divider circuit 584 comprised of resistors R25 and R26 which are tapped to earlier-described line 534 to provide a low battery signal to MCU 460. Where, for example, the battery voltage drops to about 5.4 volts, the low battery condition is triggered. This relatively higher voltage threshold level is necessitated, inasmuch as the battery voltage is utilized for the purpose of driving the coils of a small shuttle valve within controller 50. That valve, in turn, controls the motor valves as at 48 or 72. Battery voltage is asserted to one input of a voltage regulator 586 which may be provided, for example, as a type LN10. The desired 5 v regulated output from precision regulator 586 is established by resistors R27 and R28 which are coupled to output line 588. The input from the network of resistors R27 and R28 is tapped at line 590 for assertion to the regulator 586. Line 588 is seen to be coupled to line 592 which, in turn, extends to VDD output line 594. Noise filtering capacitors C8–C10 are coupled between line 592 and ground. The VDD output at line 594 is coupled to integrated circuit power source inputs throughout the control circuit. Line 594, now carrying a regulated 5 v power supply is directed through forwardly biased steering diode D3 to line 598 and earlier-described voltage back-up (VBKP) line 564. Line 594 also is coupled to a 3.6 v lithium back-up battery 600 which is connectable with line 598 through steering diode D2. Thus, under normal operating conditions, diode D2 will be reversed-biased. However, upon loss of power at line 594, diode D2 will be forwardly biased to apply back-up power lines 598 and 564. Capacitor C11 functions to retain energy and smooth the transition to powering from back-up battery 600.

Line 588 carrying regulated +5 v also is seen to be directed to an input of a low voltage indicator 602. Device 602 trips to a low reset output which is presented at line 604 where, for example, the regulated power supply voltage drops to 4.6 v. This develops one of the earlier-described reset inputs, for example, to MCU 460 as discussed in connection with line 464. Device 602 may be provided, for example, as a type MC33064 marketed by Motorola, Inc. A reset function also can be developed from an external terminal block coupled with line 604. Line 604 is seen directed to an RC delay network 606 incorporating resistor R29 and capacitor C12, in turn, connected within line 596 carrying regulated VDD voltage. Line 604 extends to one input of a NAND gate 608, the opposite input to which is coupled to VDD through line 610. Thus, with the presence of a reset input, a pulse is developed at output line 612 which is directed through gate resistor R30 to the gate of FET transistor Q1. The drain of transistor Q1 is coupled via line 614 to reset line 604, while the source thereof is coupled via line 616 to ground. Accordingly, upon the application of a reset pulse, line 604 is drawn to a reset signal created logic low level.

Figure 13:
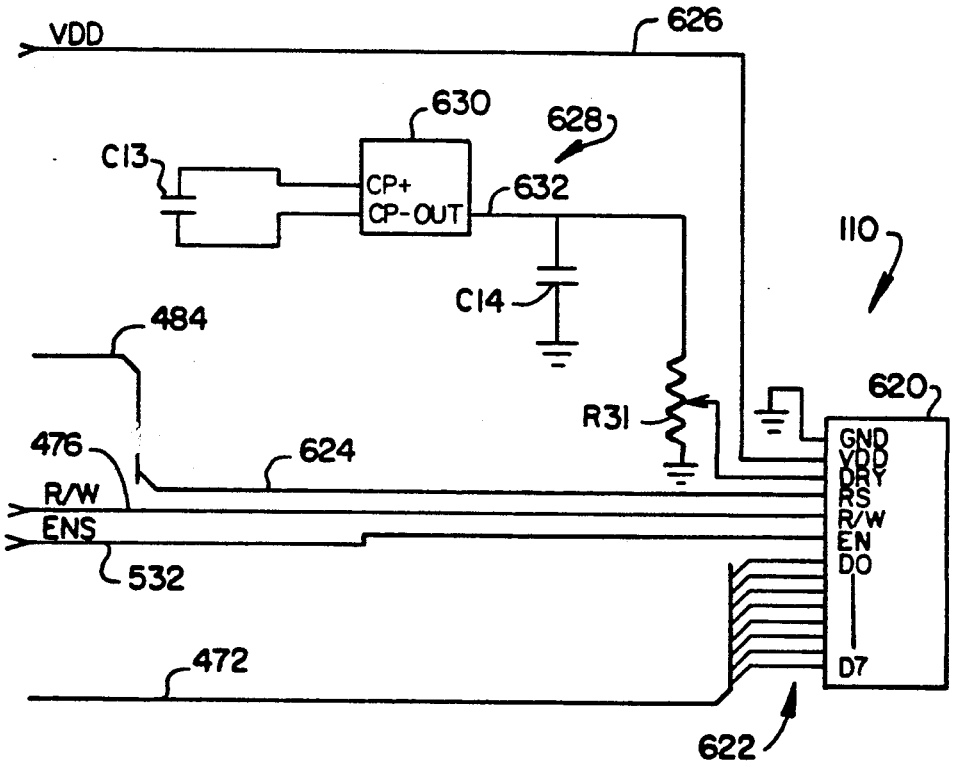
FIG. 13 is an electrical schematic diagram of a circuit employed with a controller utilized with the invention showing display components.

Referring to FIG. 13, the circuitry associated with readout 110 is revealed. Circuit 110 employes, as its principal component, a liquid crystal display (LCD) dot matrix module providing for two rows of 16 characters in a 5×7 character format. Device 620 may be provided, for example, as a type TLCM1621 marketed by Three-Five Systems, Inc.

Character data are supplied to device 620 from databus 472 which is directed by lead array 622 to the D0–D7 inputs thereto. Enablement to the device is from earlier-described line 532 and read/write commands (R/W) are provided from earlier-described line 476. A register select input is provided from one lead 624 of 16-bit address bus 484. The signals at this lead provide for election of communication with a character generator function or the display data RAM function. +5 v VDD supply is provided from line 626 to the corresponding input terminal and a −5 v input is generated for the driver voltage (DR V) input terminal from a network 628. Network 628 includes a voltage inverter or charge pump 630, the CP+ and CP− terminals of which are coupled with a capacitor C13 and the output of which at line 632 is coupled with a capacitor C14. Capacitors C13 and C14 operate in conjunction with the diode network and switching of device 630 to generate the noted −5 v requirement of device 620. This voltage can be trimmed at trimming potentiometer R31.

Figure 14:
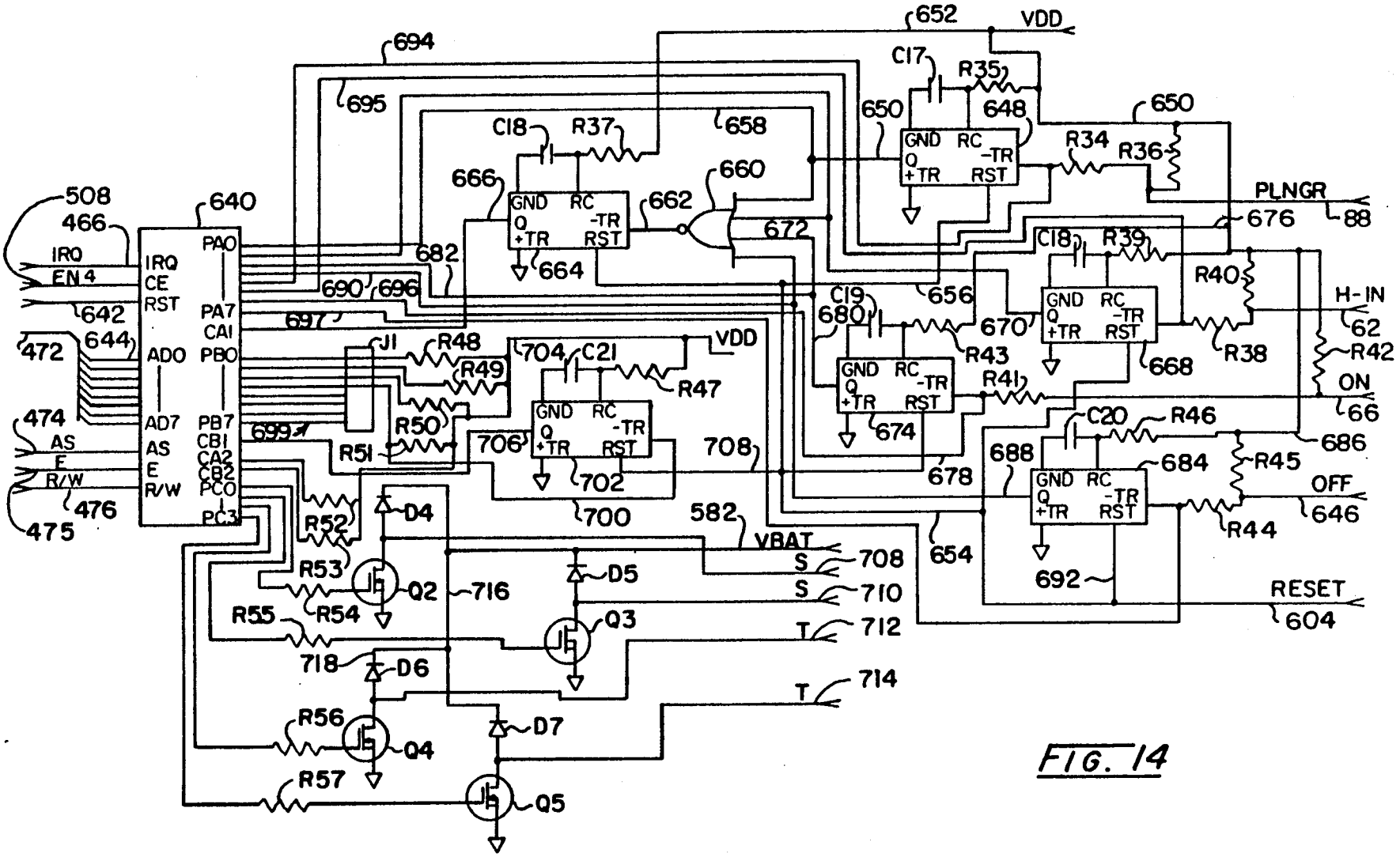
FIG. 14 is an electrical schematic diagram of a circuit employed with a controller used with the invention showing peripheral interface functions.

Turning to FIG. 14, the peripheral components of the controller 50 are shown. These components perform in conjunction with a peripheral interface adapter PIA (640). PIA 640 may be provided, for example, as a type MC146823CP CMOS parallel interface marketed by Motorola, Inc. and provides the earlier-described interrupt request (IRQ) at line 466 which is directed to MCU 460. Enablement (EN4) to the CE terminal of device 640 is derived from earlier-described line 508 and a reset input thereto is derived from earlier-described line 604 and is shown at line 642. Data bus 472 is coupled with the AD0–AD7 terminals via lead array 644. An address strobe (AS) is provided to the device 460 from earlier-described line 474; enablement is provided thereto from earlier-described line 475; and read and write instructions (R/W) are provided from earlier-described line 476.

Inputs ultimately submitted to PIA 640 are represented to the right of the drawing. In this regard, the plunger arrival signal earlier described at 88 again reappears along with a high line (H-LN) signal as earlier described from line 62. Where desired, an external on representing, for example, a high casing pressure and being the equivalent of the depression of on button, E (FIG. 9) may be supplied as represented at line 66. An equivalent external off signal can be submitted as represented at line 646 and the earlier-described reset input of line 604 is directed into the circuit at hand as represented by that same line identification. Looking to the plunger signal at line 88, the closure of contacts from gauge 60 will be of very short interval. Accordingly, the signal is submitted through input resistor R34 to the trigger input of a one-shot multivibrator 648. Device 648 may be provided, for example, as a type IC4538 and functions on the falling edge of the input to stretch the signal for presentation at line 650 at its Q output. The extent of pulse stretching is selected by the values of capacitor C17 and resistor R35 coupled, respectively, to the ground and RC inputs thereof. A pull-up resistor R36 is coupled to line 88 and is seen to extend to VDD supply at line 650, which, in turn, is coupled to line 652. Line 652 is ultimately connected with earlier-described line 594. The reset (RST) terminal of device 648 is coupled with reset input line 604 via lines 654 and 656. Output line 650 now carrying the stretch pulse, is directed to two inputs, one extending via line 658 to the PA0 input port of PIA 640, and the other extending to one input of a four input NOR gate 660, the output of which at line 662 is directed to the trigger input of another one-shot multivibrator 664. The reset input to device 664 is from line 656, while the pulse definition generated thereby is developed by the combination of capacitor C18 and resistor R37. The latter components provide for a pulse timing shorter than that developed by device 648 which is submitted at the Q output and line 666 to the capture port CA1 of PIA 640. Thus, the input to device 640 at its PAO output from line 658 is, in effect, latched upon the short pulsing input to terminal CA1. This same form of signal input will be seen to occur with other peripherally developed signals. In this regard, it may be noted that the high line input at line 62 is seen to be directed through input resistor R38 to the trigger input of one-shot multivibrator 668. Configured identically as device 648 through selection of capacitor C18 and resistor R39, the pulse output developed thereby at its Q terminal and line 670 is directed to the second input of NOR gate 660 via line 672 and, additionally, to the PA1 terminal of PIA 640. That signal received at gate 660 is again employed to trigger device 664 and submit a capture signal to port CA1 of device 640. A pull-up resistor R40 is seen coupled between line 62 and VDD supply line 652. The reset terminal of device 668 is seen to be coupled with line 604.

The on signal at line 66 is seen to be coupled to pull-up resistor R42 and extends through input resistor R41 to the trigger input of one-shot multi-vibrator 674. Device 674 is configured similarly to devices 668 and 648 through selection of values for resistor R43 and capacitor C19. These components are seen to be coupled within line 676 extending from VDD source line 652. The reset input to device 674 is from line 678, coupled, in turn, to line 654. The pulse stretch output at the Q terminal of device 674 is directed via line 680 to the third input of gate 660 and via line 682 to the PA2 terminal of PIA 640. Thus, the signal presented at line 66 is treated in the same manner as discussed in conjunction with devices 648 and 668.

Where an external off signal is provided from line 646, it, in similar fashion is directed through input resistor R4 to the trigger input of one-shot multivibrator 684. Line 646 is coupled to pull-up resistor R45 which, in turn, is coupled to line 686 carrying VDD source from line 652. Device 684 is configured for pulse stretching by capacitor C20 operating in conjunction with resistor R46 within line 686. The pulse stretched output at the Q terminal of device 684 is directed via line 688 to the fourth input of NOR gate 660 and via line 690 to the PA3 terminal of PIA 640. The device 684 thus is employed in the same manner as devices 648, 668, and 674. The reset input to device 684 is seen to be coupled via line 692 to reset line 604. The signals developed at lines 88, 62, 66, and 646, following their submission through respective input resistors R34, R38, R46, and R44, are directed via lines 694–697 to the PA4–PA7 terminals of PIA 640.

Accessing of the row-column matrix of keypad 112 is provided through a connector J1 and lead array 699 by the B port components PB0–PB7 of PIA 640. In this regard, certain of these ports are configured internally to be input lines while others are output lines. To react to a command or enter signal from the bottom row of keypad 112, device 640 provides a short signal via line 700 on the trigger input of one-shot multi-vibrator 702. Device 702 may be structured identically with, for example, device 648 and is configured for the purpose of stretching the signal input at line 700 through selection of the values for capacitor C21 and resistor R47 which are coupled to VDD source from line 704. Line 704 will be seen to be coupled through pull-up resistors R48–R51 to the corresponding PB0–PB3 terminals of device 640. The resultant stretched pulse from device 702 is directed via line 706 to the capture input terminal CB1 of device 640. Thus, with information that the keypad is being accessed, the row column matrix thereof is read to the alerted MCU device 460. The reset input to device 702, as well as to device 674 is from lines 708, 654, and 604. Additional pull-up resistors R52 and R53 are coupled between line 704 carrying source VDD and catch terminals CA2 and CB2.

Control over sales valve 48 and tank valve 72 initially is by a small coil driven valve which provides for pneumatic driving of the diaphragms of the motor valves themselves. In this regard, the sales valve 48 is actuated by a pneumatic valve, the coils of which are driven alternately from lines 708 to 710 in conjunction with the full battery voltage (VDAT) developed from line 582, an extension thereof being identified by the same numeration in this figure. These lines are activated by drawing them to a true or active low state. Similarly, the tank valve 72 is actuated by a small pneumatic valve having two alternative coil actuations which are carried out by drawing lines 712 and 714 to an active low condition. For the present embodiment, field effect transistors (FETs) Q2–Q5 are employed for the switching involved. In this regard, the drain terminals of transistors Q2–Q5 are commonly connected with battery voltage through lines 582, 716, and 718. Blocking diodes D4–D7 also are coupled to this source input for the purpose of blocking inductive spikes occasioned with the de-energization of the coils. Each of the source terminals of transistors Q2–Q5 are coupled to ground and lines 708, 710, 712, and 714 are seen to be connected to the drain terminals of each. To control the transistors Q2–Q5, the gate terminals thereof are coupled through respective gate resistors R54–R57 to terminals PC0–PC3 of PIA 640. Accordingly, upon gating of these transistors, the coupled line so elected as at 708, 710, 712, or 714 is drawn active low to turn on the coil associated therewith and, in turn, actuate an associated motor valve 48 or 72. Alternately, the coils are turned off.

Since certain changes may be made in the above method without departing from the scope of the invention herein involved, it is intended that all matter contained in the above description or shown in the accompanying drawings shall be interpreted as illustrative and not in a limiting sense.

I claim:

1. The method for operating a well installation having a control valve regulating the flow of fluid hydrocarbon from a well tubing string to a sales line which is selectively actuated between an on-state and an off-state, and wherein a plunger is located within the said tubing string of said well for movement between a lower region and a wellhead sensing position, comprising the steps of:

assigning first values corresponding with the rate of movement of said plunger from said lower region to said wellhead which represent normal plunger performance;

assigning second values less than said first values corresponding with the rate of movement of said plunger from said lower region to said wellhead which represent slow plunger performance;

assigning a predetermined value for the time interval of said on-state;

assigning a predetermined value for time interval of said off-state;

actuating said control valve to transition from an off-state to an on-state;

then detecting the arrival of said plunger at said wellhead prior to expiration of said predetermined value for the time interval of said on-state, and determining the time elapsed from said actuation;

determining the presence of any coincidence of said time elapsed from said actuation of said control valve with said assigned second values;

then increasing said predetermined value for the time interval of said off-state by a predetermined first time increment when a said coincidence with said assigned second value is present; and terminating the said on-state in response to said plunger detection, and actuating said control valve to transition from said on-state to the next off-state in response to said termination of said on-state.

2. The method of claim 1 including the steps of:

assigning a predetermined first number for the occurrences of the arrival of said plunger at rates of movement at first assigned values;

assigning a predetermined time interval of an afterflow delay;

determining the presence of any coincidence of said time elapsed from said actuation of said control valve with said assigned first values;

counting the occurrences of said presence of a coincidence with said assigned first values; and extending the said on-state upon the said detection of the arrival of said plunger for the said predetermined time interval of an afterflow delay when the number of occurrences of a coincidence with said assigned first values equals said first number.

3. The method of claim 2 including the step of decreasing said predetermined time interval of an afterflow delay by a predetermined second time increment when said coincidence with said assigned second values is present.

4. The method of claim 1 including the steps of:

assigning a predetermined second number for the occurrences of the arrival of said plunger corresponding with rates of movement at said second assigned values;

determining the presence of any said coincidence of said time elapsed from said actuation of said control valve with said assigned second values;

counting the occurrences of said presence of a coincidence with said assigned second values; and carrying out said actuation of said control valve to transition from the next previous said on-state to the next said off-state and thereafter maintaining said off-state to establish a shut-in condition when the number of said occurrences of a coincidence with said assigned second value equals said second number.

5. The method of claim 1 including the steps of:

assigning third values greater than said first values corresponding with the rate of movement of said plunger from said lower region to said well head which represent rapid plunger performance;

determining the presence of any coincidence of said time elapsed from said actuation of said control valve with said assigned third values; and decreasing said predetermined value for the time interval of said off-state by a predetermined third time increment when said coincidence with said assigned third values is present.

6. The method of claim 5 including the steps of:

assigning a predetermined off-state minimum value for the time interval of said off-state;

comparing said off-state minimum value with the next previous value for the time interval of said off-state when a said coincidence with said assigned third values occurs; and maintaining said off-state minimum value when said next previous value for the time interval of the off-state is equal to said off-state minimum value.

7. The method of claim 5 including the steps of:

assigning a predetermined third number for the occurrence of the arrival of said plunger at rates of movement at said third assigned values;

counting the occurrences of said presence of a coincidence of said time elapsed from said actuation of said control valve with said third assigned values;

assigning a predetermined time interval of an afterflow delay;

increasing said predetermined time interval of an afterflow delay by a predetermined fourth time increment to derive an increased afterflow delay for the condition where the number of said counted occurrences of said presence of a coincidence with said third assigned values equals said predetermined third number; and extending the said time interval of said on-state for the time interval of said increased afterflow delay upon the occurrence of said condition and the next occurring arrival of said plunger at a said rate of movement which corresponds with said rapid plunger performance corresponding with said third values.

8. The method for operating a well installation having a sales control valve regulating the flow of fluid hydrocarbon from a well tubing string to a sales line-is selectively actuated to establish an on-state and an off-state, wherein a tank is provided for receiving fluid, and wherein a plunger is located within said tubing string for movement between a lower region and a well head sensing position, comprising the steps of:

providing a tank control valve coupled for regulating the flow of fluid hydrocarbon from said well tubing string to said tank, said tank control valve being actuable to establish a tank on-state and further actuable to close fluid flow communication between said tubing string and said tank;

assigning select values corresponding with the rate of movement of said plunger from said lower region to said wellhead which represent predetermined plunger performance;

assigning a value for a tank-on-time interval;

assigning a predetermined value for the time interval of said on-state;

assigning a predetermined value for the time interval of said off-state;

actuating said sales control valve to transition from an off-state to an on-state and commencing the timing of said on-state;

providing an arrival signal when said plunger arrives at said wellhead subsequent to the actuation of said sales control valve to transition to a said on-state;

actuating said sales control valve to said off-state when said time interval of said on-state is concluded in the absence of said arrival signal;

determining the presence of a tank cycle condition when said time interval of said on-state is concluded in the absence of said arrival signal;

actuating said tank control valve in response to said tank cycle condition to establish said tank on-state and commencing the timing of said tank-on-time interval; and actuating said tank control valve to close and terminate said fluid flow communication in response to said arrival signal and commencing the timing of said off-state.

9. The method of claim 8 including the steps of:

actuating said tank control valve to close and terminate said fluid flow communication in response to the completion of said tank-on interval in the absence of said arrival signal; and then carrying out said commencement of the timing of said off-state.

10. The method of claim 9 including the step of increasing said predetermined value for the time interval of said off-state when said tank-on interval completion occurs in the absence of said arrival signal.

11. The method of claim 9 including the steps of:

assigning a predetermined interval for an afterflow delay; and altering said predetermined interval for an afterflow delay to a zero time value when said tank-on interval completion occurs in the absence of said arrival signal.

12. The method of claim 9 including the steps of:

assigning a predetermined no-arrival number for the occurrences of a termination of said tank-on interval in the absence of a generation of a said arrival signal;

counting the occurrences of a termination of said tank-on interval in the absence of a generation of a said arrival signal to derive a no-arrival count; and carrying out said actuation of said sales control valve to said off-state to establish a shut-in condition when said no-arrival count equals said predetermined no-arrival number.

13. The method of claim 8 including the steps of:

assigning a predetermined interval for an afterflow delay; and decreasing said predetermined interval for an afterflow delay by a select increment of time when said arrival signal occurs during the occurrence of said tank-on interval.

14. The method for operating a well installation having a control valve regulating the flow of hydrocarbon from a well tubing string to a sales line which is selectively actuated between an on-cycle and an off-cycle, each having time intervals, and wherein a plunger is located within said tubing string of said well for movement at a given rate between a lower region and a wellhead sensing portion, comprising the steps of:

assigning a predetermined fixed value for the time interval of said on-cycle;

assigning first values corresponding with a said rate of movement of said plunger from said lower region to said wellhead which represent normal plunger performance;

assigning second values corresponding with the rate of movement of said plunger from said lower region to said well head which represent fast plunger performance;

assigning a predetermined initial value for a said time interval of said off-cycle;

assigning a predetermined minimum value for a said time interval of said off-cycle;

actuating said control valve to transition from said off-cycle to said on-cycle;

providing an arrival signal when said plunger arrives at said wellhead subsequent to the said actuation of said control valve to transition to said on-cycle;

determining the presence of a fast plunger rate when said arrival signal occurs within a time interval from said control valve actuation to transition to said on-cycle corresponding with said second values;

decreasing said initial value for the time interval of said off-cycle by a predetermined increment of time in response to said determination of a fast plunger rate to derive an adjusted value for said time interval of off-cycle; and maintaining said predetermined minimum value for said time interval of said off-cycle when said adjusted value is equal thereto.

15. The method of claim 14 including the steps of:

determining the presence of a normal plunger rate when said arrival signal occurs within a time interval commencing from said on-cycle control valve actuation corresponding with said first values;

maintaining the then existing value for the time interval of said off-cycle in the presence of said determination of said normal plunger rate.

16. The method of 14 including the steps of:

assigning a predetermined initial value for the time interval of an afterflow delay; and selectively delaying the commencement of said off-cycle by the amount of said afterflow delay initial value in response to said determination of a fast plunger rate.

17. The method of claim 16 including the steps of:

increasing said initial value of said afterflow delay by a predetermined afterflow time increment upon the occurrence of a select number of said determinations of a fast plunger rate.

18. The method of claim 17 including the steps of:

selectively delaying the commencement of said off-cycle by the then present amount of said afterflow delay upon the occurrence of a select number of said determinations of a good plunger rate.

19. The method for operating a well installation having a sales control valve regulating the flow of hydrocarbon from a well tubing string to a sales line which is selectively actuated between open and closed orientations for respectively deriving an on-cycle and an off-cycle, wherein a plunger is located within said tubing string for movement between a lower region and a wellhead sensing position, and wherein a switching gauge is operatively associated with said sales line to derive a high line signal when pressure within said sales line reaches a predetermined threshold level, comprising the steps of:

actuating said sales control valve from said closed orientation to said open orientation to commence said on-cycle;

timing said on-cycle for an on-cycle control interval;

timing an afterflow extension of said on-cycle for an afterflow delay interval;

actuating said sales control valve from said on-cycle to said off-cycle at the termination of said afterflow delay interval;

timing said off-cycle for an off-cycle control interval;

commencing the timing of an on-cycle high line delay interval in response to the presence of said high line signal during said timing of said on-cycle and suspending the remaining time of said on-cycle;

responding to the removal of said high line signal during said on-cycle high line delay interval by reinstating said on-cycle for said remaining on-cycle time;

actuating said sales control valve to said closed orientation when said on-cycle high line delay interval terminates during said on-cycle control interval and maintaining said closed orientation until the subsequent removal of said high line signal; and actuating said sales control valve to said open orientation to commence a said on-cycle in response to said subsequent removal of said high line signal.

20. The method of claim 19 including the steps of:

commencing the timing of an off-cycle high line delay interval in response to the presence of said high line signal during said timing of said off-cycle and suspending the remaining time of said off-cycle; and responding to the removal of said high line signal during said off-cycle high line delay interval by reinstating said off-cycle for said remaining off-cycle time.

21. The method of claim 19 including the steps of:

commencing the timing of an afterflow high line delay interval in response to the presence of said high line signal during said timing of said afterflow delay interval and suspending the remaining time of said afterflow interval; and responding to the removal of said high line signal during said afterflow high line delay by reinstating said afterflow delay for said remaining time of said afterflow interval.

22. The method of claim 21 including the steps of:

actuating said sales control valve to said closed orientation when said afterflow high line delay interval terminates during said afterflow delay interval and maintaining said closed orientation until the subsequent removal of said high line signal;

actuating said sales control valve to said open orientation to commence a said on-cycle in response to said subsequent removal of said high line signal.

* * * * *

US005146991C1

(12) EX PARTE REEXAMINATION CERTIFICATE (5245th)

United States Patent
Rogers, Jr.

(10) Number: US 5,146,991 C1
(45) Certificate Issued: Dec. 20, 2005

(54) METHOD FOR WELL PRODUCTION

(75) Inventor: Jack R. Rogers, Jr., Tyler, TX (US)

(73) Assignee: Delaware Capital Formation, Inc., Wilmington, DE (US)

Reexamination Request:
No. 90/005,850, Nov. 3, 2000

Reexamination Certificate for:

| | |
|---|---|
| Patent No.: | **5,146,991** |
| Issued: | **Sep. 15, 1992** |
| Appl. No.: | **07/684,162** |
| Filed: | **Apr. 11, 1991** |

(51) Int. Cl.[7] ..... E21B 34/16; E21B 43/12
(52) U.S. Cl. ..... 166/369; 166/53; 137/624.15; 137/552.7; 137/624.2
(58) Field of Search ..... 166/53, 64, 66, 166/369, 370, 372; 137/624.2, 624.15, 552.7

(56) References Cited

U.S. PATENT DOCUMENTS 4,352,376 A 10/1982 Norwood
4,921,048 A 5/1990 Crow

OTHER PUBLICATIONS

Process Instruments & Controls Handbook, 2ndE. pp iv, v, 1–24, 25, 26, 27: 18–22, 23, 18, 19, 20, 21, 24, 25.
Program Design Guide—Man. No. 550–8107 pp vii, 6–25.
VPV200/550 Programming Guide—Man No. VPV200/550–8108 pp vii, 6–14.
WellMaster Zoo—Production Management System Operation Basic Manual—All + Sup.

*Primary Examiner*—Frank Tsay

(57) ABSTRACT

A method for producing a plunger lift well which optimizes production through the evaluation of the speed at which a plunger arrives at the wellhead within a fixed on-cycle interval. Time interval windows representing fast, good, and slow plunger performance are established and, based upon plunger performance with respect to these windows, afterflow time and off-cycle intervals are varied toward an achievement of plunger arrivals within the good window. A minimum off-time is established as a limit. The method may be employed with two motor valves, one performing in conjunction with a sales and the other to low pressure such as the atmospheric pressure of a tank or a low pressure sales line. In the event of failure of the plunger to arrive within the on-cycle interval, resort is made to the tank cycle. Additionally, an afterflow delay cycle is provided as well as a delay cycle intended for response to high sales line pressure conditions.

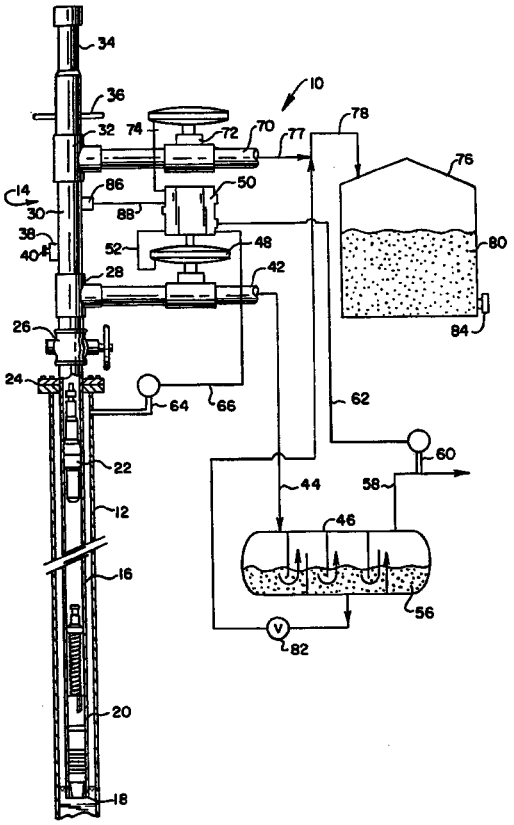

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–22 is confirmed.

* * * * *